US009454109B2

(12) United States Patent
Kojima et al.

(10) Patent No.: US 9,454,109 B2
(45) Date of Patent: Sep. 27, 2016

(54) IMAGE FORMING APPARATUS CONTROLLING TRANSFER CONDITIONS BASED ON RESISTANCE OF TRANSFER MEMBER

(71) Applicant: CANON KABUSHIKI KAISHA, Tokyo (JP)

(72) Inventors: Etsuji Kojima, Kashiwa (JP); Tetsuya Ohta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/840,564

(22) Filed: Aug. 31, 2015

(65) Prior Publication Data

US 2016/0077468 A1 Mar. 17, 2016

(30) Foreign Application Priority Data

Sep. 12, 2014 (JP) ..... 2014-186412

(51) Int. Cl.
*G03G 15/16* (2006.01)

(52) U.S. Cl.
CPC ..... *G03G 15/1665* (2013.01)

(58) Field of Classification Search
CPC ..... G03G 15/1675; G03G 15/1605; G03G 15/1665; G03G 15/1615; G03G 2215/0129
See application file for complete search history.

(56) References Cited

U.S. PATENT DOCUMENTS 6,360,071 B1 3/2002 Tomizawa
8,050,604 B2 11/2011 Tominaga
8,831,452 B2 * 9/2014 Yamada ..... G03G 15/1675 399/44
2006/0198667 A1 * 9/2006 Furuya ..... G03G 15/1685 399/313
2009/0067864 A1 * 3/2009 Shirafuji ..... G03G 15/161 399/66
2009/0080924 A1 * 3/2009 Kojima ..... G03G 15/0131 399/66
2014/0161494 A1 * 6/2014 Ishizumi ..... G03G 15/0189 399/301

FOREIGN PATENT DOCUMENTS

JP 2000-347519 A 12/2000
JP 2001-117376 A 4/2001
JP 2003-241447 A 8/2003
JP 2009-063902 A 3/2009
JP 2013-186340 A 9/2013

* cited by examiner

*Primary Examiner* — Francis Gray
(74) *Attorney, Agent, or Firm* — Fitzpatrick, Cella, Harper & Scinto

(57) ABSTRACT

An image forming apparatus includes: an image bearing member; a toner image forming unit; a belt member; a transfer member; a transfer voltage source for generating a voltage applied to the transfer member; an obtaining portion for obtaining information on an electric resistance of the belt member; a detecting member for optically detecting a test toner image formed on the image bearing member and transferred on the belt member; and an executing portion for executing, on the basis of a detection result of the test toner image by the detecting member, an adjusting operation for adjusting an image forming condition of the toner image forming unit. The executing portion sets, on the basis of the information, a voltage applied to the transfer member when the test toner image is transferred onto the belt member in the adjusting operation.

10 Claims, 15 Drawing Sheets

IMAGE FORMING APPARATUS CONTROLLING TRANSFER CONDITIONS BASED ON RESISTANCE OF TRANSFER MEMBER

FIELD OF THE INVENTION AND RELATED ART

The present invention relates to an image forming apparatus, such as a copying machine, a printer, a facsimile machine, using an electrophotographic type or an electrostatic recording type.

In a conventional image forming apparatus of the electrophotographic type or the electrostatic recording type, an electrostatic latent image formed on an image bearing member is developed as a toner image, and the toner image is transferred onto a toner image receiving member. As a type in which the electrostatic latent image is developed, there is a two-component developing type using a two-component developer in which a non-magnetic toner and a magnetic carrier are mixed. In the image forming apparatus using a developing device of the two-component developing type, an adjusting operation (hereinafter, also referred to simply as density control) for adjusting an image density by detecting and adjusting a toner density (content or concentration) (a mixing ratio of the toner (T) to the carrier (C) (T/D ratio)) is carried out. As a method of the density control, there is a method in which a predetermined test toner (hereafter, also referred to as a patch) is formed and a density of the patch is detected and then on the basis of a detection result thereof, toner supply to the developer is controlled.

On the other hand, conventionally, as an intermediary transfer member onto which the toner image is transferred from the image bearing member or as a transfer material carrying member for feeding a transfer material onto which the toner image is transferred from the image bearing member, an endless belt-shaped sheet (film), a drum-shaped sheet extended to a frame, and the like have been widely used. Hereinafter, these sheets used as the intermediary transfer member or the transfer material carrying member are also referred to simply as an image feeding sheet. The toner image transfer from the image bearing member onto the image feeding sheet or the transfer material on the image feeding sheet is electrostatically performed by, e.g., applying a transfer voltage (transfer bias) to a transfer member provided opposed to the image bearing member through the image feeding sheet thereby to supply a transfer current to a transfer portion.

In Japanese Laid-Open Patent Application 2009-63902, as a material for the image feeding sheet, a material adjusted so as to have a desired electric resistance by dispersing electroconductive particles such as carbon black in a thermoplastic resin material or a thermosetting resin material, or the like material is used.

However, the image feeding sheet fluctuates in electric resistance by repetitive use thereof. For example, in the case where the resin-mode image feeding sheet containing the electroconductive particles as described above is used, a surface resistance gradually lowers with repetitive use in some cases. As one of causes thereof, the following cause would be considered. That is, the electroconductive particles of the image feeding sheet are electrically charged by electric discharge or the like generating between itself and the transfer material at the transfer portion, so that the electric discharge generates between the electroconductive particles by a local electric field generated between the electroconductive particles. Then, a resin portion between the electroconductive particles is degraded and carbonized under application of heat by the electric discharge, so that the resin portion loses an insulative property and becomes an electroconductor. It would be considered that the surface resistance of the image feeding sheet lowers by repetition of such a phenomenon.

In the image forming apparatus using the image feeding sheet, in the density control, after a patch is transferred from the image bearing member onto the image feeding sheet, a patch density is detected on the image feeding sheet by a density sensor in some cases. In such a constitution, when the electric resistance of the image feeding sheet fluctuates by the repetitive use of the image feeding sheet, even in the case where the toner density of the developer is the same, the patch density on the image feeding sheet changes in some cases. This is because a transfer property of the toner image at the transfer portion where the toner image is transferred from the image bearing member onto the image feeding sheet. Accordingly, when the toner supply is controlled on the basis of a detection result of the patch density, an error in toner density of the developer relative to a desired value generates, so that an image density fluctuates in some cases.

In general, the transfer current supplied to the transfer portion is set so that a current value when a good transfer property is obtained is a target current value It. The transfer current value It of the transfer current is obtained through an experiment or the like in advance and then is stored in the image forming apparatus. FIG. 20 shows a relationship between the transfer current and the transfer property in the image forming apparatus of the electrophotographic type at the transfer portion where the toner image is transferred from a photosensitive drum as the image bearing member onto an intermediary transfer belt as the image feeding sheet. In FIG. 20, the abscissa represents a transfer current at a solid white portion, and the ordinate represents a density (transfer residual (toner image) density) of the toner image remaining on the photosensitive drum at a solid black portion. A smaller transfer residual density (a lower portion in FIG. 20) means that the transfer property is better. In the case of FIG. 20, the target current value It of the transfer current is set at 10 μA which is a current value at which the transfer residual density is minimum.

However, in the case where the electric resistance of the intermediary transfer belt fluctuates, a change in transfer property generates. FIG. 21 shows a comparison of the relationship between the transfer current and the transfer property in the case where the surface resistance of the intermediary transfer belt is different. The transfer property is shown by the transfer residual density similarly as in FIG. 20. In the case of FIG. 21, with a smaller surface resistance of the intermediary transfer belt, the relationship between the transfer current and the transfer property shifts in a transfer current decreasing direction. This is because an area of an electric field applied to the photosensitive drum by the voltage applied to the intermediary transfer belt broadens.

The target current value It of the transfer current during the image formation is set in general at such a value that there is no influence on the image or the influence on the image is negligible even when the above-described shift of the relationship between the transfer current and the transfer property generates. This is because the above-described shift of the relationship between the transfer current and the transfer property is very small throughout a lifetime period of the image feeding sheet in general, and therefore it is possible to set the target current value It of the transfer current.

However, with respect to accuracy of the density control using the patch, the influence of the above-described shift of the relationship between the transfer current and the transfer property becomes large in some cases. This is because in the density control, the toner density of the developer in a developing device is obtained by a difference in density of the patch transferred onto the image feeding sheet. On the other hand, by reducing the influence of the fluctuation in transfer property at the transfer portion on the patch density to the possible extent, it becomes possible to effect the density control with high accuracy.

Incidentally, there is also a constitution in which the patch density is detected on the image bearing member in order to eliminate the influence of the fluctuation in transfer property at the transfer portion on the patch density. However, particularly in a tandem-type image forming apparatus in which toner images are transferred from a plurality of image bearing members onto the image feeding sheet, there is a need to provide a density sensor at a plurality of positions (for yellow, magenta, cyan and black in general), and therefore an increase in cost, upsizing of the image forming apparatus and complication are liable to be caused.

In the above, the case where the surface resistance of the image feeding sheet lowers by the repetitive use of the image feeding sheet was described as an example, but a similar problem can occur in the case where the electric resistance of the image feeding sheet fluctuates by the repetitive use.

Further, in the above, the conventional problem in the case where an object to be adjusted by the adjusting operation using the patch is the toner density of the developer was described. However, a similar problem can occur in an adjusting operation for adjusting an object to be adjusted depending on a difference between a detected patch density and a reference value also in the case where the object to be adjusted by the adjusting operation using the patch is other objects such as a charging condition or an exposure condition of the photosensitive member, a developing condition of the electrostatic latent image, or an image signal.

SUMMARY OF THE INVENTION

According to an aspect of the present invention, there is provided an image forming apparatus comprising: an image bearing member; a toner image forming unit for forming a toner image on the image bearing member; a belt member for carrying the toner image transferred from the image bearing member; a transfer member for transferring the toner image from the image bearing member onto the belt member at a transfer portion; a transfer voltage source for generating a voltage applied to the transfer member; an obtaining portion for obtaining information on an electric resistance of the belt member; a detecting member for optically detecting a test toner image formed on the image bearing member and transferred on the belt member; and an executing portion for executing, on the basis of a detection result of the test toner image by the detecting member, an adjusting operation for adjusting an image forming condition of the toner image forming unit, wherein the executing portion sets, on the basis of the information obtained by the obtaining portion, a voltage applied to the transfer member when the test toner image is transferred onto the belt member in the adjusting operation.

These and other objects, features and advantages of the present invention will become more apparent upon a consideration of the following description of the preferred embodiments of the present invention taken in conjunction with the accompanying drawings.

DESCRIPTION OF THE EMBODIMENTS

An image forming apparatus according to the present invention will be described with reference to the drawings.

Embodiment 1

1. General Structure and Operation of Image Forming Apparatus

Figure 1:
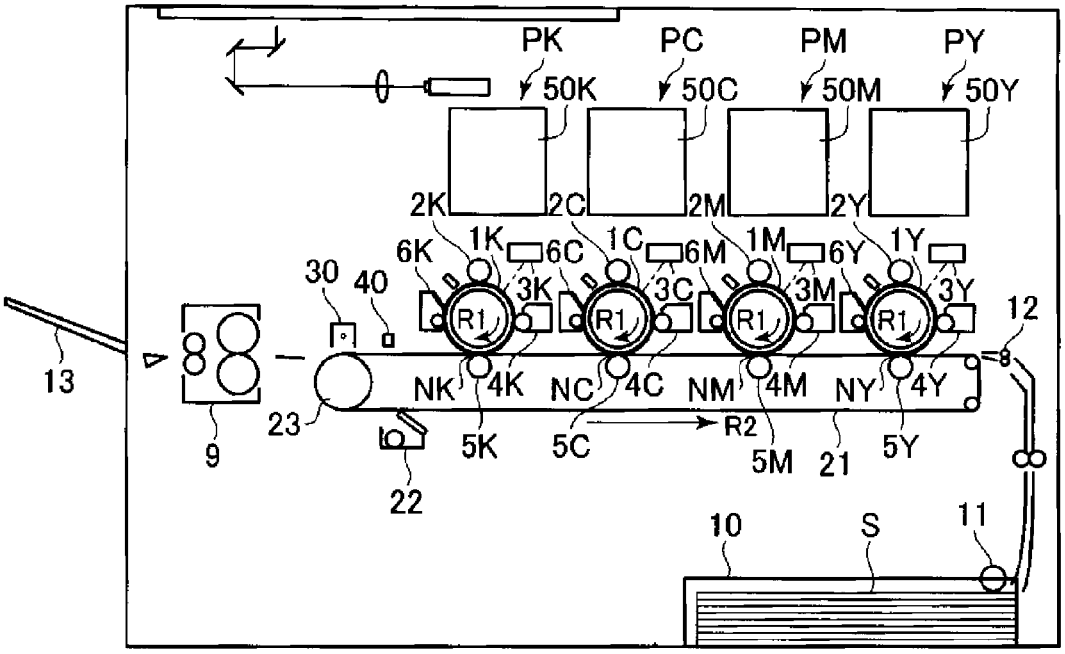
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem color image forming apparatus which is capable of forming a full-color image using an electrophotographic type and which employs a direct transfer type.

The image forming apparatus 100 includes, as a plurality of image forming portions, first to fourth image forming portions (stations) PY, PM, PC and PK for forming images of yellow (Y), magenta (M), cyan (C) and black (K), respectively. These four image forming portions PY, PM, PC and PK are disposed in line along a movement direction of a transfer belt 21 described hereinafter.

In this embodiment, basic constitutions and operations of the image forming portions PY, PM, PC and PK are substantially the same except that the colors of toners used are different from each other. Accordingly, in the following, in the case where particular distinction is not required, suffixes Y, M, C and K for representing elements for associated colors, respectively, are omitted, and the elements will be collectively described.

At the image forming portion P, a photosensitive drum 1 which is a rotatable drum-shaped (cylindrical) electrophotographic photosensitive member as an image bearing member is provided. The photosensitive drum 1 is rotationally driven in an arrow R1 direction. At a periphery of the photosensitive drum 1, along a rotational direction of the photosensitive drum 1, the following process devices are provided. First, a charging roller 2 which is a roller-shaped charging member as a charging means is disposed. Next, an exposure device (laser scanner device) 3 as an exposure means is disposed. Next, a developing device 4 as a developing means is disposed. Next, a transfer roller 5 which is a roller-shaped transfer member as a transfer means. Next, a drum cleaning device 6 as a photosensitive member cleaning means is disposed.

Further, the image forming apparatus 100 includes a transfer belt 21 as a transfer material carrying member which is disposed opposed to the photosensitive drums 1 of the image forming portions P and which is constituted by an endless belt-shaped sheet (film). The transfer belt 21 is an image feeding sheet for carrying a transfer material onto which a toner image is electrostatically transferred from the image bearing member. The transfer belt 21 is wound around a plurality of supporting rollers with predetermined tension. The transfer belt 21 is rotationally driven in an arrow R2 direction by a driving roller 23 which is one of the plurality of supporting rollers. In an inner peripheral (back) surface side of the transfer belt 21, at positions opposing the photosensitive drums 1, the above-described transfer rollers 5 are disposed. Each of the primary transfer rollers 5 is urged (pressed) against the transfer belt 21 toward the associated photosensitive drum 1, so that a transfer portion (transfer nip) N where the transfer belt 21 and the photosensitive drum 1 contact each other is formed. The transfer belt 21 carried and feeds a transfer material S thereon. As the transfer material S, a single sheet formed in an endless belt shape and a sheet which is a seamless belt are used. As a material for the transfer belt 12, a material adjusted to have a desired electric resistance by dispersing electroconductive particles such as carbon black into a thermoplastic resin material or a thermosetting resin material.

During image formation, the photosensitive drum 1 is rotationally driven in an arrow R1 direction in the figure at a predetermined peripheral speed (process speed), so that a surface of the rotating photosensitive drum 1 is electrically charged uniformly to a predetermined polarity (negative in this embodiment) and a predetermined potential. At this time, to the charging roller 2, from a charging voltage source (not shown) as a charging voltage applying means, a charging voltage (charging bias) is applied in a predetermined condition. The charged surface of the photosensitive drum 1 is subjected to scanning exposure to laser light depending on image information by the exposure device 3. As a result, an electrostatic latent image (electrostatic image) depending on the image information is formed on the photosensitive drum 1. The electrostatic latent image is formed on the photosensitive drum 1 is developed (visualized) with a developer into a toner image by the developing device.

The toner image formed on the photosensitive drum 1 is electrostatically transferred at the transfer portion N onto the transfer material S, by the action of the transfer roller 5, as a toner image receiving member nipped and fed between the photosensitive drum 1 and the transfer belt 21 while being carried on the transfer belt 21. At this time, to the transfer roller 5, from a transfer voltage source E (FIG. 4) as a transfer voltage applying means, a transfer voltage (transfer belt bias) which is a DC voltage of an opposite polarity to a toner charge polarity (normal toner charge polarity) during development is applied.

The transfer material S such as a recording sheet (paper) is accommodated in a transfer material cassette 10 and is supplied onto the transfer belt 21 by a feeding roller 11, a registration roller 12 and the like, and then is fed by the transfer belt 21 to be successively sent to each of the transfer portions N.

For example, during full-color image formation, the color toner images of yellow, magenta, cyan and black formed on the photosensitive drums 1 of the image forming portions P are successively transferred superposedly onto the transfer material S at the transfer portions N. The transfer belt 21 is rotationally driven by the driving roller 23 in an arrow B direction in the figure at substantially the same peripheral speed as the peripheral speed of the photosensitive drum 1, so that the transfer belt 21 not only attracts and carries the transfer material S sent to the registration roller 12 but also feeds the transfer material S toward the transfer portions N. An image writing signal is turned on substantially simultaneously with the supply of the transfer material S to the transfer belt 21, and at predetermined timing based thereon, image formation on each of the photosensitive drums 1 of the image forming portions P is effected. At each of the transfer portion N, the transfer roller 5 opposing the photosensitive drum 1 through the transfer belt 21 imparts an electric field or electric charges to the transfer belt 21, so that the toner image is transferred from the photosensitive drum 1 onto the transfer material S. By this electric field or the electric charges, the transfer material S is firmly held and fed on the transfer belt 21 by an electrostatic attraction force.

The transfer material S on which the toner image is transferred is charge-removed by a separation charger 30 at a position downstream of the downstreammost transfer portion NK with respect to a movement direction of the transfer belt 21 to attenuate the electrostatic attraction force, and thus is separated (demounted) from the transfer belt 21. The transfer material S separated from the transfer belt 21 is fed to a fixing device 9 as a fixing means. The fixing device 9 feeds the transfer material S while heating and pressing the transfer material S, whereby the fixing device 9 effects color mixing of the toner image and fixing of the toner image on the transfer material S. The transfer material S on which the toner image is fixed by the fixing device 9 is discharged onto a tray 13 provided at an outer portion of a main assembly of the image forming apparatus 100.

On the other hand, a toner (transfer residual toner) remaining on the surface of the photosensitive drum 1 after a transfer step is removed from the surface of the photosensitive drum 1 by a drum cleaning device 6 and is collected. The drum cleaning device 6 removes the transfer residual toner from the surface of the rotating photosensitive drum 1 by a cleaning member such as a fur brush or a blade disposed in contact with the photosensitive drum 1. The toner deposited on the surface of the transfer belt 21 is removed from the surface of the transfer belt 21 by a belt cleaning device 22 and is collected. The belt cleaning device 22 removes the deposited toner or the like from the surface of the rotating transfer belt 21 by a cleaning member such as a fur brush or a blade disposed in contact with the transfer belt 21. The belt cleaning device 22 is disposed downstream of a separated position of the transfer material S from the transfer belt 21 and upstream of the upstreammost transfer portion NK with respect to the movement direction of the transfer belt 21, and removes a fog toner, a scattered toner and the like deposited on the surface of the transfer belt 21.

In this embodiment, a toner image forming means for forming the toner image on the photosensitive drum 1 is constituted by the charging roller 2, the exposure device 3 and the developing device 4.

2. Developing Device

Figure 2:
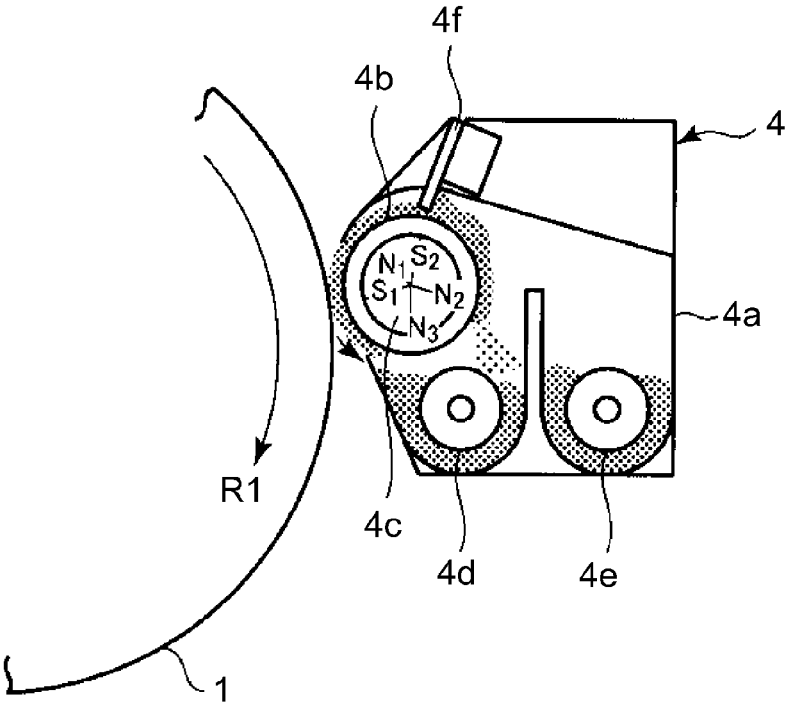
FIG. 2 is a schematic sectional view of a developing device.

The developing device 4 will be described. FIG. 2 is a schematic sectional view of the developing device 4 in this embodiment. The developing device 4 includes a developing container 4*a* in which a two-component developer containing a non-magnetic toner and a magnetic carrier mixed in a predetermined mixing ratio is filled in a predetermined amount. In the developing devices 4Y, 4M, 4C and 4K of the image forming portions PY, PM, PC and PK, the toners of yellow, magenta, cyan and black are accommodated, respectively. At an opening of the developing container 4*a* opposing the photosensitive drum 1, a developing sleeve 4*b* as a rotatable developer carrying member is provided. The developing sleeve 4*b* is rotationally driven in a direction in which surface movement directions of the developing sleeve 4*b* and the photosensitive drum 1 at a developing portion which is an opposing portion to the photosensitive drum 1 are the same direction. Inside the developing sleeve 4*b*, a magnet roller 4*c* as a magnetic field generating means is fixed and disposed. Inside the developing container, stirring screws 4*d* and 4*e* for stirring and feeding the developer are disposed. Further, the developing device 4 is provided with a regulating blade 4*f* for forming a thin layer by regulating the developer carried on the surface of the developing sleeve 4*b*.

The developer carried on the surface of the developing sleeve 4*b* by a magnetic force generated by the magnet roller 4*c* is fed by rotation of the developing sleeve 4*b* and reaches the developing portion after the layer thickness thereof is regulated by the regulating blade 4*f*. The developer on the developing sleeve 4*b* forms an erected magnetic brush at the developing portion, and contacts the surface of the photosensitive drum 1 in this embodiment. To the developing sleeve 4*b*, from a developing voltage source (not shown) as a developing voltage applying means, a developing voltage (developing bias) is applied in a predetermined condition. Then, depending on the electrostatic latent image, the toner is supplied from the developer on the developing sleeve 4*b* to the photosensitive drum 1. In this embodiment, the toner image is formed by image portion exposure and reverse development. That is, on an exposed portion (light portion) of the photosensitive drum 1 lowered in absolute value of a potential by exposure after the uniform charging, the toner charged to the same polarity (negative in this embodiment) as the charge polarity of the photosensitive drum 1 is deposited.

In this embodiment, as the magnetic carrier, a ferrite magnetic carrier of 24 $Am^2/kg$ in saturation magnetization under an applied magnetic field of 240 kA/m, $1\times10^6$-$1\times10^{10}$ Ω·cm in specific resistance at an electric field strength of 3000 V/cm, and 50 μm in weight-average particle size was used. In this embodiment, as the non-magnetic toner, a negatively chargeable polyester resin toner of 7.2 μm in weight-average particle size obtained by externally adding hydrophobic colloidal silica into colored resin particles was used. As the magnetic carrier, a resin magnetic carrier manufactured by a polymerization method using a binder resin, a magnetic metal oxide and a non-magnetic metal oxide as starting materials may also be used, and the manufacturing method of the magnetic carrier is not particularly limited. Further, as the non-magnetic toner, a styrene-acrylic resin toner may also be used. In this embodiment, a mixture of the magnetic carrier and the non-magnetic toner in a weight ratio of 93:7 was used as the developer.

3. Operation Sequence

Figure 3:
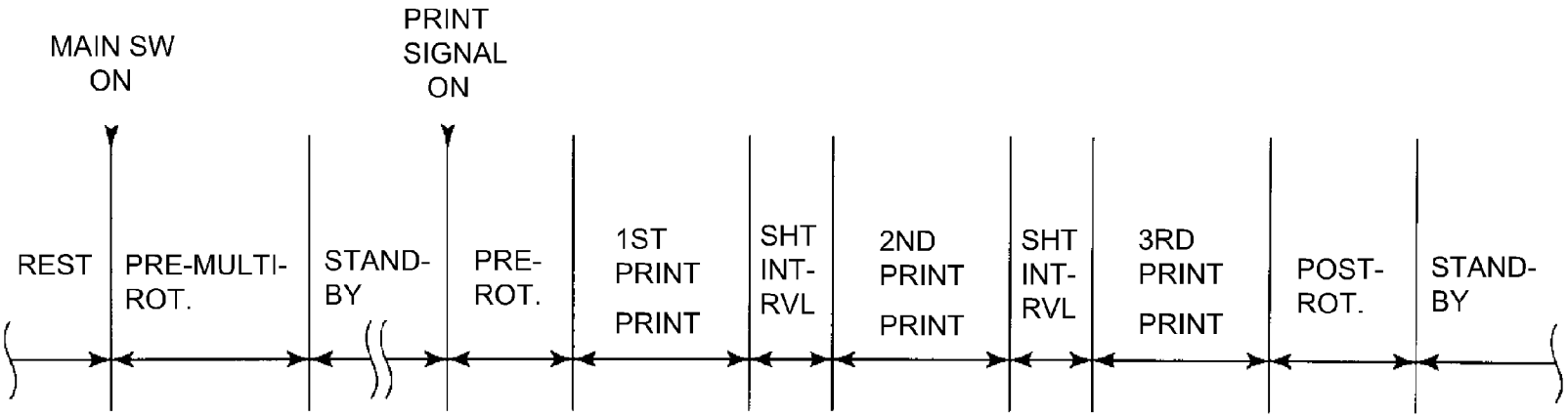
FIG. 3 is a diagram showing an operation sequence of the image forming apparatus.

FIG. 3 shows an operation sequence of the image forming apparatus 100.

a. Initial Rotation Operation (Pre-Multi-Rotation Step)

An initial rotation operation is performed in a preparatory operation period (starting operation period, actuation operation period, warming period) during actuation of the image forming apparatus 100. In the initial rotation operation, the photosensitive drum 1 is rotationally driven by turning on a main (power) switch of the image forming apparatus 100 and a preparatory operation of a predetermined process device, such as rising of the fixing device 9 to a predetermined temperature is executed.

b. Print-Preparatory Rotation Operation (Pre-Rotation Step)

A print-preparatory rotation operation is performed in a preparatory operation period from an input of a print signal (an image output operation start signal) into the image forming apparatus 100 until a printing step is actually started. When the print signal is inputted during the initial rotation operation, the print-preparatory rotation operation is executed subsequently to the initial rotation operation. When there is no input of the print signal, the drive of a main motor is once stopped after the end of the initial rotation operation and the rotational drive of the photosensitive drum 1 is stopped, so that the image forming apparatus 100 is maintained in a stand-by state until a subsequent print signal is inputted. Then, when the print signal is inputted, the print-preparatory rotation operation is executed.

c. Printing Step (Image Forming Operation)

A printing step is performed in a period in which the toner image formation of the photosensitive drum 1, the toner image transfer onto the transfer material S, the toner image fixing on the transfer material S and the like are actually executed. Specifically, timing of the printing step differs at each of positions where the steps of the charging, the exposure, the development, the transfer and the fixing are executed. In the case of an operation in a continuous printing mode, the above-described printing step is repetitively formed correspondingly to a predetermined see print number n (n=3 in the case of FIG. 3).

d. Sheet-Interval Step

A sheet-interval step is performed in a period corresponding to a period, in which there is no transfer material S at the transfer position, from after passing of a trailing end of a transfer material S until a leading end of a subsequent transfer material S reaches the transfer position.

e. Post-Rotation Step

A post-rotation step is performed is a period in which the photosensitive drum 1 is rotationally driven by continuing the drive of the main motor for some time even after the printing step for a final transfer material S is ended, and thus a predetermined post-operation is executed.

f. Stand-by Step

When the predetermined post-operation is ended, the drive of the main motor is stopped and thus the rotational drive of the photosensitive drum 1 is stopped, so that the image forming apparatus 100 is maintained in a stand-by state until a subsequent print signal is inputted. In the case of printing of a single sheet, after the end of the printing, the image forming apparatus 100 is in the stand-by state through the post-rotation step. In the stand-by state, when the print signal is inputted, the operation of the image forming apparatus 100 shifts to the print-preparatory rotation operation.

The printing step c described above is performed during image formation, and the initial rotation step a, the print-preparatory step b, the sheet-interval step d and the post-rotation step e which are described above are performed during non-image formation. A series of operations including the above-described print-preparatory rotation operation and operations in the printing step, the sheet-interval step, the post-rotation step and the like is also referred to as an image outputting operation (job).

4. Control Manner

Figure 4:
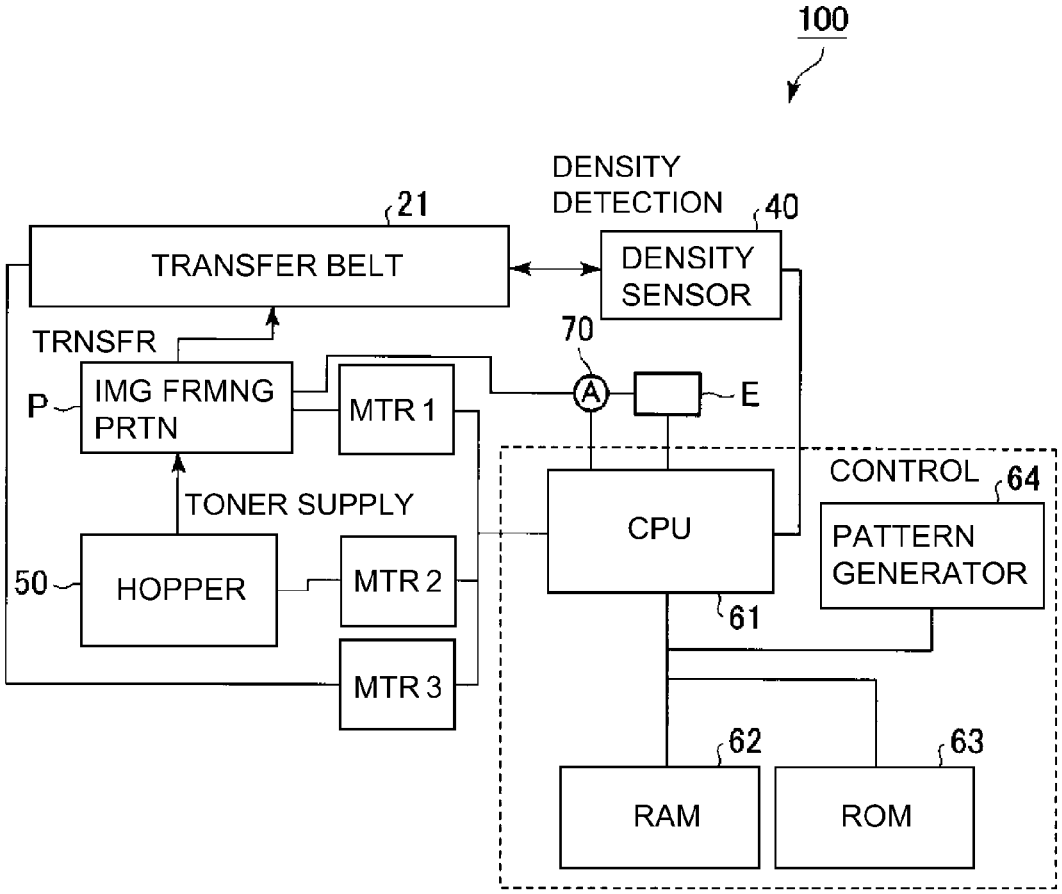
FIG. 4 is a block diagram showing a control manner of a principal part of the image forming apparatus.

FIG. 4 is a block diagram showing a schematic control manner of a principal part of the image forming apparatus 100. The image forming apparatus 100 in this embodiment includes CPU 61 as a control means for controlling the operation of the image forming apparatus 100. The CPU 61 controls not only a motor 1 for rotationally driving the photosensitive drum 1, a motor 2 for rotationally driving a supplying member (not shown) for a hopper 50, a motor 3 for rotationally driving the driving roller 23 for the transfer belt 21 but also a general operation of the image forming apparatus 100. To the CPU 61, RAM 62 used as a working memory, ROM 63 in which a program executed by the CPU 61 and various data used for the control are stored, and a test pattern generating portion 64 are connected. The test pattern generating portion 64 is mounted in a video controller (not shown) in some cases.

In this embodiment, a transfer current measuring circuit 70 as a current detecting means (also referred to as a transfer ammeter) is provided between the transfer voltage source E and the transfer roller 5. As a result, the transfer ammeter 70 can detect a value of a DC current flowing through the transfer roller 5 when the transfer voltage source E applies a DC voltage to the transfer roller 5. The transfer ammeter 70 may only be required to measure the DC current value between the photosensitive drum 1 and the transfer roller 5, and therefore may also be provided between the photosensitive drum 1 and the ground. In this embodiment, the transfer voltage source E is constituted so that the transfer voltage source E can output a constant voltage having a voltage value set by the control of the CPU 61. It is possible to apply a voltage for supplying a predetermined current from the transfer voltage source E to the transfer roller 5 by changing a set value of an output of the transfer voltage source E so that the current value detected by the transfer ammeter 70 is a predetermined current value. The CPU 61 can obtain information on each of the voltage value and the current value from the set value of the output of the transfer voltage source E and a detection result of the transfer ammeter 70 at that time.

5. Basic Operation of Density Control

A basic operation of density control (developer density control) for adjusting a toner density (content) of the developer in this embodiment will be described. In the image forming apparatus 100 in this embodiment, the density control for detecting and adjusting the toner density (T/D ratio) of the developer in the developing device 4 is carried out. This density control is executed by the CPU 61. In the density control in this embodiment, an adjusting toner image (patch) is formed on the transfer belt 21, and then a density of thus patch is detected by a density sensor 40 provided opposed to the transfer belt 21. This density sensor 40 is an example of a density detecting means for detecting the density of the toner image on the image feeding sheet. The density sensor 40 is disposed opposed to the surface of the transfer belt 21 at a position downstream of the downstream-most transfer portion NK and upstream of the separation charger 30 with respect to the movement direction of the transfer belt 21. The density sensor 40 is constituted by an optical sensor and includes a light-projecting (emitting) portion including an light source element such as LED and a light-receiving portion including a light-receiving element such as a photo-diode. The density sensor 40 irradiates the patch on the transfer belt 21 with light emitted from the light-projecting portion and receives reflected light from the patch by the light-receiving portion, and then inputs a signal depending on a light quantity of the received light into the CPU 61.

Figure 5:
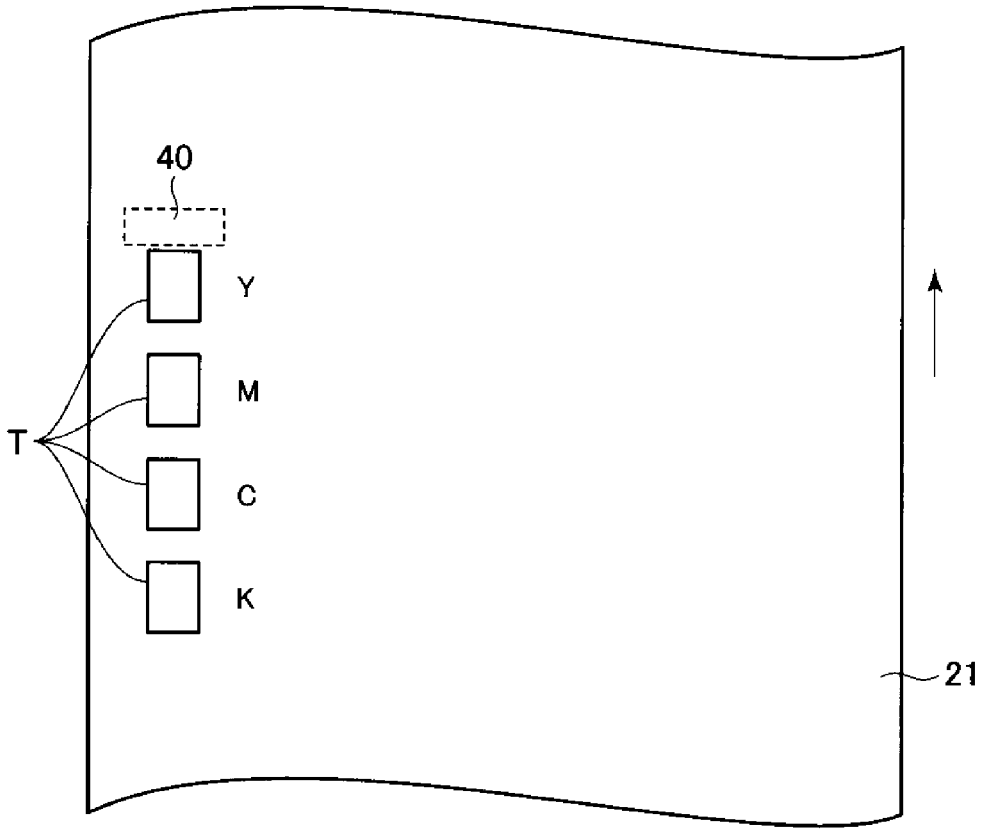
FIG. 5 is a schematic view of a patch on a transfer belt.

The patch formation is made in the following manner. First depending on a signal from the test pattern generating portion 64, a latent image for the patch for providing a predetermined contrast voltage is formed on the photosensitive drum 1 and is developed, so that the patch is formed on the photosensitive drum 1. In this embodiment, at one density control timing, the patch is formed on each of the photosensitive drums 1Y, 1M, 10 and 1K of the image forming portions PY, PM, PC and PK. The patch for each color is transferred from the associated one of the photosensitive drum, 1Y, 1M, 10 and 1K onto the transfer belt 21. As a result, as shown in FIG. 5, patches T for the respective colors arranged in line along the movement direction of the transfer belt 21 are formed on the transfer belt 21. In this embodiment, each of the patches T is a half-tone image using a predetermined screen. A species of the screen and a half-tone level (darkness) are set so that sensitivity at which a density difference generates most conspicuous when the patch T is detected by the density sensor is good.

Densities of the patches for the respective colors transferred on the transfer belt 21 are successively detected by the density sensor 40 with the movement of the transfer belt 21. The density sensor 40 inputs the signal depending on the density of each of the patches T for the colors. Then, the CPU 61 obtains the toner density of each of the developers for the colors from the density of the associated patch T as described later. The patch T for which reading by the density sensor 40 is ended is removed by the belt cleaning device 22.

In this embodiment, when the image forming apparatus 100 is started to be used, the patch T in an initial state (in which the toner density of the developer is a predetermined initial density) is formed in a predetermined condition, and then the density thereof is detected. A detection thereof is set as a reference value (reference density) of the density of the patch T, and is stored in the ROM 63. In subsequent density control, the toner density is discriminated by a comparison of the detection result of the patch T formed in the predetermined condition with the reference value. When the density of the patch T is low, the toner density of the developer is discriminated as being low, so that toner supply from the hopper (toner supplying unit) 50 as a supplying means to the developing device 4 is made. On the other hand, when the density of the patch T is high, the toner density of the developer is discriminated as being high, so that the toner supply to the developing device 4 is not made. An amount of the toner supplied to the developing device 4 is adjusted in accordance with an instruction from the CPU 61 depending on an amount of the toner, to be supplied from the hopper 50 to the developing device 4, by controlling an operation amount of the supplying member (not shown) such as the screw provided in the hopper 50.

Figure 6:
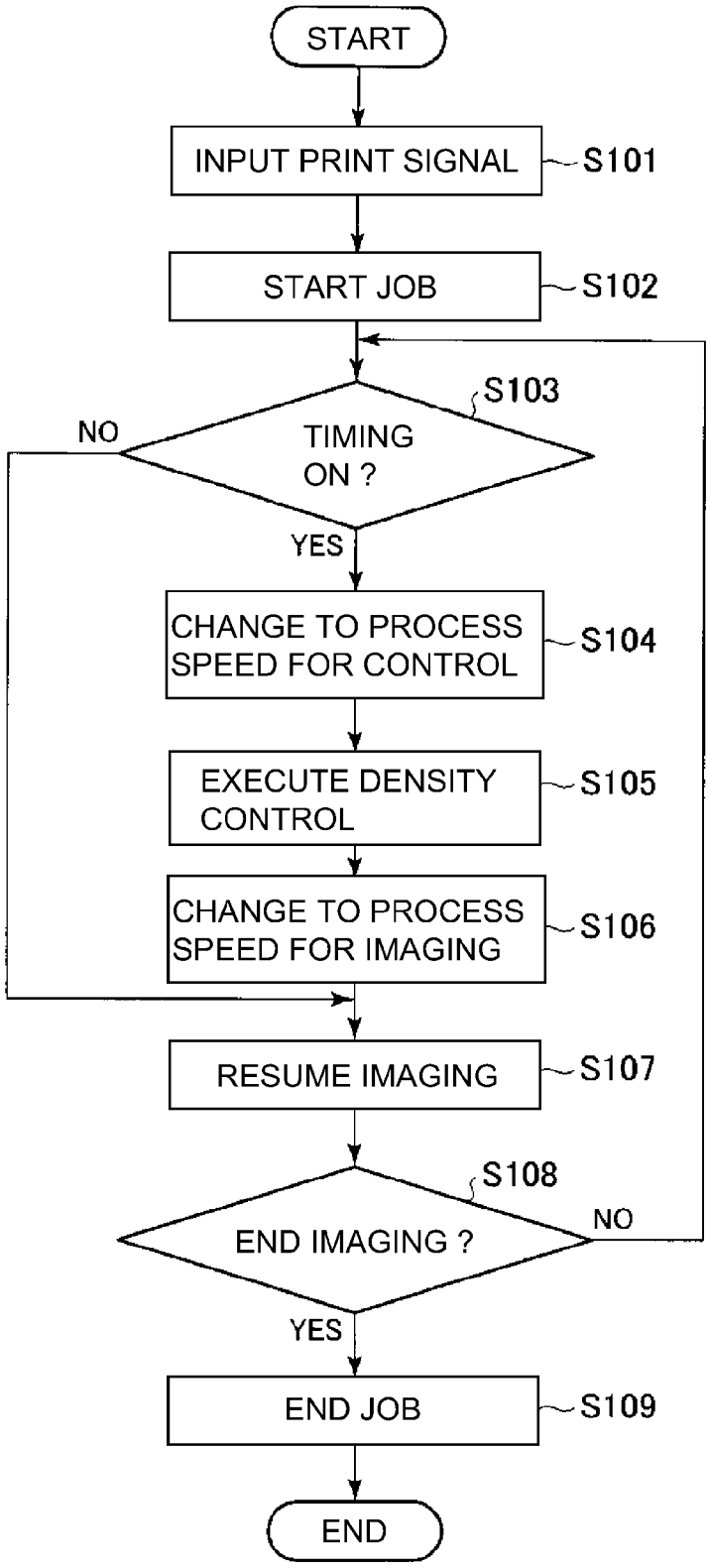
FIG. 6 is a flow chart showing a flow of an image output operation.

FIG. 6 is a flow chart showing a flow of a series of image outputting operations including discrimination of execution of the density control in this embodiment.

First, when the print signal is inputted (S101), the CPU 61 starts the job (S102). In this embodiment, the case where a print signal instructing image formation in a low-speed mode is inputted will be described as an example. The CPU 61 makes reference to the RAM 62 and the ROM 63 substantially simultaneously with the start of the job, and checks whether or not the timing is density control timing (S103). In the RAM 62 and the ROM 63, data base for determining the density control timing is stored. In this embodiment, the density control is effected in the case where the number of sheets for image output reaches a predetermined number of sheets. Accordingly, in this embodiment, when the print signal is inputted, count of the image output sheet number is made. Then, the CPU 61 can discriminate the number of sheets at which the timing becomes the density control timing.

In the step of S103, in the case where the CPU 61 discriminates that the timing is not the density control timing, the CPU 61 continues the image formation of the job as it is (S107). On the other hand, in the step of S103, in the case where the CPU 61 discriminates that the timing is the density control timing, the CPU 61 changes the process speed to a speed for control in order to execute the density control (S104). In this embodiment, the CPU 61 changes the process speed in the low-speed mode to a process speed in a normal (speed) mode as the speed for control. Thereafter, the CPU 61 executes the density control (S105). As described above, in the density control, the density of the patch T is detected by the density sensor 40 and is compared with the reference density, so that the toner supply amount is adjusted. As a result, the toner density of the developer is properly maintained, so that generation of an image defect such as a density fluctuation is suppressed. In this embodiment, control for adjusting a target current value of the transfer current when the patch T is transferred onto the transfer belt 21 during the density control is effected, but this control will be described hereinafter in detail.

Although the timing of the density control varies depending on the speed for discrimination in the step S102 and the step of S103, the density control may also be carried out in the pre-rotation step before the image forming step or in the sheet-interval step. The density control can be appropriately executed in synchronism with the state of the image forming apparatus 100 when the timing reaches the contact timing. Further, even in the case where the timing reaches the density control timing during a continuous image forming job, the density control may also be executed in the post-rotation step after all of the image forming steps are ended or in the pre-rotation step for a subsequent job.

After the density control is executed, the CPU 61 changes the process speed of the image forming apparatus 100 to the process speed in the low-speed mode in order to resume the image formation (S106). Then, the CPU 61 continues the image formation (S107). Thereafter, when all of the steps of the image formation in the job are ended (S108), the CPU 61 ends the job (S109). On the other hand, in the case where all of the steps of the image formation are not ended (S108), the CPU 61 returns the process to the step of S102.

6. Transfer Voltage Control

Transfer voltage control in this embodiment will be described. In this embodiment, the transfer voltage control is basically constituted by known ATVC (active transfer voltage control). That is, in the pre-rotation step, when there is no transfer material S at the transfer portion N, the voltage is applied from the transfer voltage source E to the transfer roller 5, and information on the voltage value and the current voltage at that time is obtained. Then, on the basis of the information, a target voltage value of the transfer voltage to be applied from the transfer voltage source E to the transfer roller 5 through the constant voltage control during the image formation is obtained. As described above, in this embodiment, the CPU 61 can obtain the information on each of the voltage value and the current value from the jet value of the output of the transfer voltage source E and the detection result of the transfer ammeter 70.

Specifically, in the transfer voltage control, the target voltage value of the transfer voltage during the image formation can be obtained in the following manner. For example, a generated voltage value when a voltage subjected to constant-current control at a predetermined target current value is applied from the transfer voltage source E to the transfer roller 5 in the transfer voltage control is obtained. Then, the generated voltage itself or a value induced using a predetermined computing equation or look-up table set in advance on the basis of the value of the generated voltage can be used as the value voltage value of the transfer voltage during the image formation. Or, the voltage applied from the transfer voltage source E to the transfer roller 5 is gradually changed, and then a relationship between the voltage value and the current value is obtained. Then, on the basis of the relationship, a voltage value necessary to obtain a desired transfer current value is obtained and can be used as the target voltage value of the transfer voltage during the image formation. In this embodiment, a latter method is employed as described hereinafter in detail.

Further, the transfer voltage control can be effected in the pre-rotation step in order to determine the target voltage value of the transfer voltage during the image formation in the job. However, the method of the transfer voltage control is not limited thereto, but the transfer voltage control can be effected in the pre-rotation step every job of plural times. Further, the timing of the transfer voltage control is not limited to the pre-rotation step, but the transfer voltage control can also be effected at appropriate timing if the timing is during the non-image formation such as the sheet-interval step or the post-rotation step.

Figure 7:
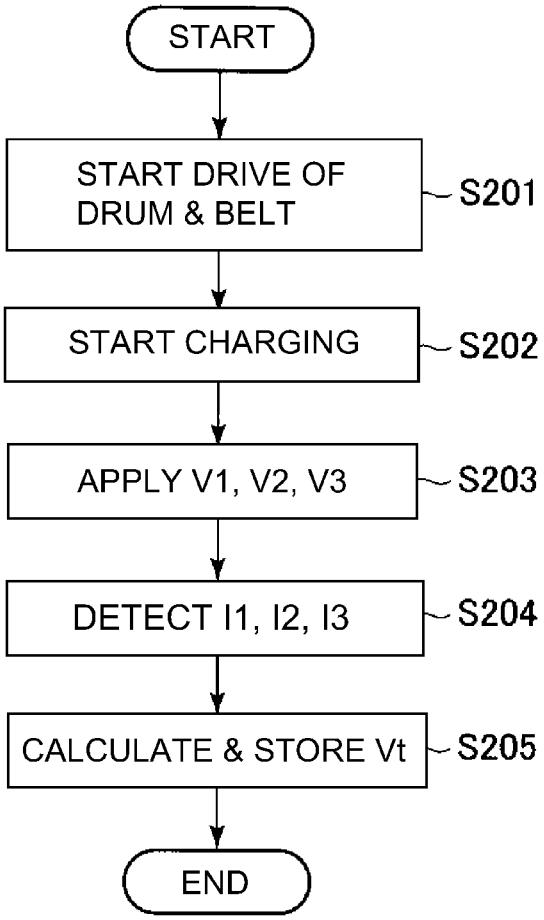
FIG. 7 is a flowchart showing a procedure of a transfer voltage control.
Figure 8:
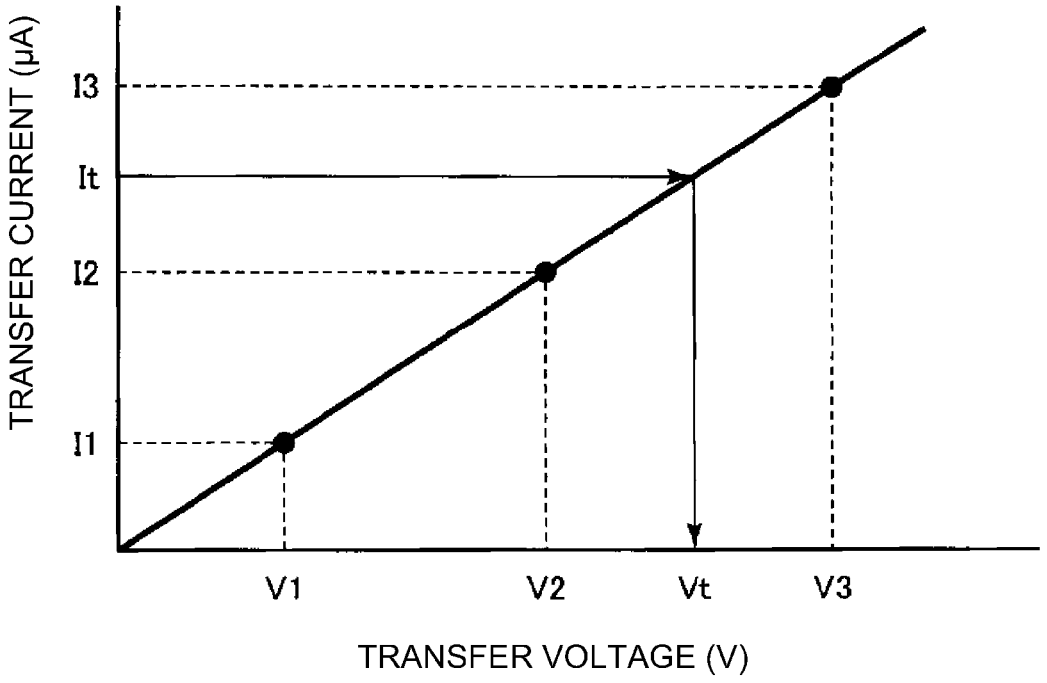
FIG. 8 is a graph showing a relationship between a voltage value of a transfer voltage and a transfer current value obtained in the transfer voltage control.

FIG. 7 is a flowchart showing a procedure of the transfer voltage control in this embodiment. FIG. 8 shows an example of the relationship, between the voltage value of the transfer voltage and the current value, obtained in the transfer voltage control in this embodiment.

When the transfer voltage control is started, the CPU 61 starts the drive of the photosensitive drum 1 and the transfer belt 21 (S201), and applies a predetermined charging voltage from the charging voltage source (not shown) to the charging roller 2, so that the surface of the photosensitive drum 1 is charged to a predetermined charge potential Vd (S202). Then, the CPU 61 successively applies voltages having predetermined adjusting voltage values V1, V1 and V3 from the transfer voltage source E to the transfer roller 5 (S203). Then, the CPU 61 detects values of currents, by the transfer ammeter 70, flowing through the transfer roller 5 when the voltages having the adjusting voltage values V1, V2 and V3 are applied, and thus obtains detected current values I1, I2 and I3, respectively (S204). Next, on the basis of a relationship between the adjusting voltage values V1, V2 and V3 and the detected current values I1, I2 and I3, the CPU 61 calculates a voltage value from which a predetermined target current value It can be obtained, and stores the voltage value, in the RAM 62, as a target voltage value Vt of the transfer voltage during the image formation (S205). Incidentally, the target current value It is obtained, through an experiment or the like in advance, as a current value when a good transfer property can be obtained, and is stored in the ROM 63.

7. Fluctuation in Optimum Transfer Current

Figure 9:
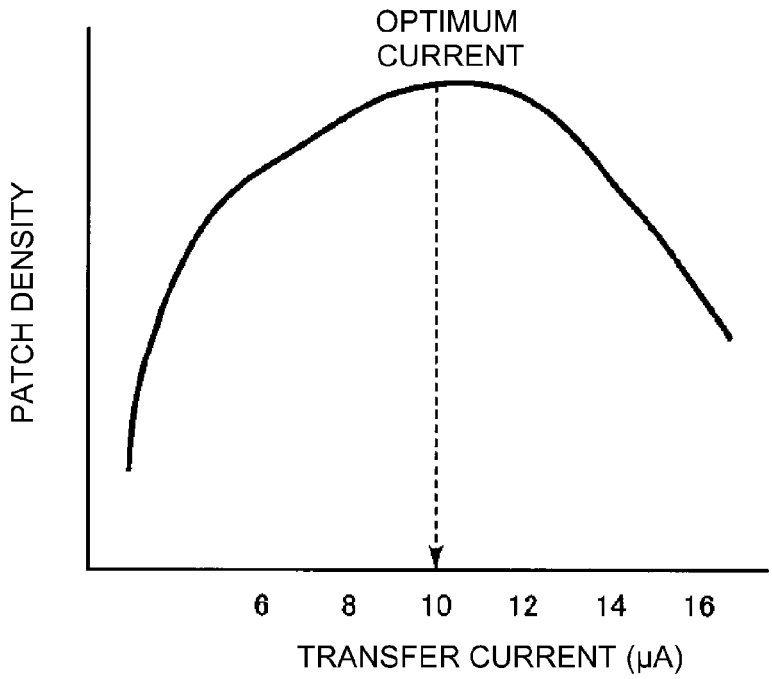
FIG. 9 is a graph showing a relationship between the transfer current and a patch density.

FIG. 9 shows a result of measurement of a relationship between the transfer current and the density of the patch T on the transfer belt 21. In this case, the transfer current during the formation of the patch T is set at the above-described target current value It, so that a transfer current value (optimum current value) at which a toner utilization actor is largest, i.e., the transfer property is best is selected.

Figure 10:
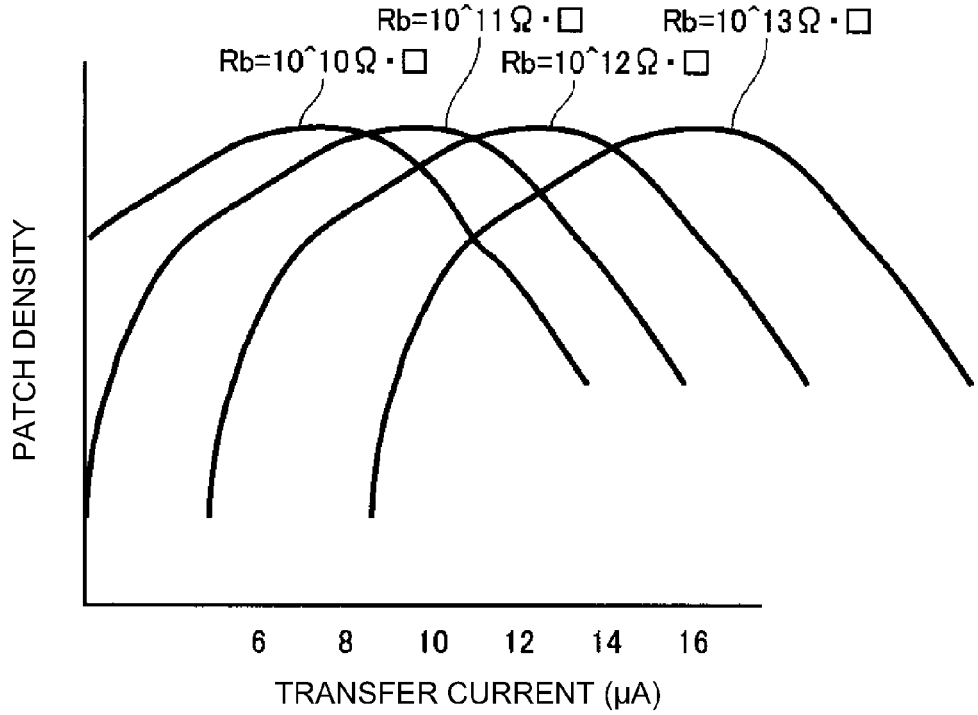
FIG. 10 is a graph showing a relationship between the transfer current and the patch density in a comparison manner in the case where the surface resistance of the transfer belt is different.

FIG. 10 shows a result of measurement of the relationship between the transfer current and the density of the patch T on the transfer belt 21 in the case where the surface resistance of the transfer belt 21 is different, in a comparison manner. From FIG. 10, it is understood that by the surface resistance of the transfer belt 21, the transfer current value (optimum current value) at which the toner utilization factor is largest, i.e., the transfer property is best fluctuates.

Figure 11:
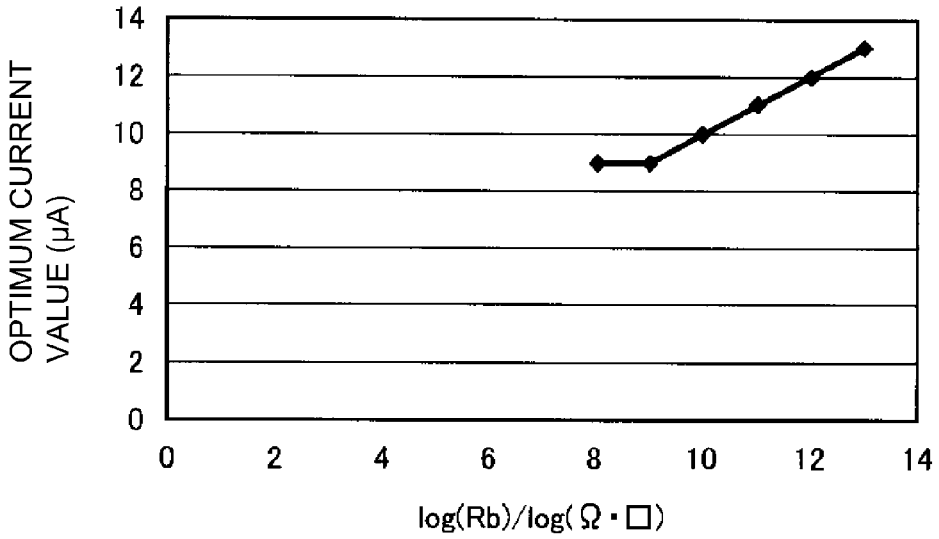
FIG. 11 is a graph showing the transfer belt surface resistance and an optimum current value of the transfer current.

FIG. 11 shows a relationship between the surface resistance of the transfer belt 21 and the optimum current value. From FIG. 11, it is understood that there is a certain correlation between the surface resistance of the transfer belt 21 and the optimum current value.

Here, as described above, the target current value It of the transfer current during the image formation is set at such a value that there is no influence on the image or a degree of the influence on the image is negligible even when shift in the above-described relationship between the transfer current and the transfer property generates due to the repetitive use of the transfer belt 21. However, with respect to accuracy of the density control using the patch T, the influence of the shift in the above-described relationship between the transfer current and the transfer property becomes large in some cases. On the other hand, by reducing the influence of the fluctuation in transfer property at the transfer portion on the density of the patch T to the possible extent, it becomes possible to effect the density control with high accuracy.

Therefore, in this embodiment, in the image forming apparatus 100, as information on the electric resistance of the transfer belt 21, the information on the surface resistance of the transfer belt 21 is obtained. Then, on the basis of the information on the surface of the resistance of the transfer belt 21, during the density control, control for adjusting the target current value of the transfer current when the patch T is transferred onto the transfer belt 21 is effected.

8. Control of Transfer Current During Density Control

Next, the control for adjusting the target current value of the transfer current when the patch T is transferred onto the transfer belt 21 in this embodiment (hereinafter, also referred to simply as target current adjusting control) will be described.

First, a method of obtaining the information on the surface resistance of the transfer belt 21 in the image forming apparatus 100 will be described.

Figure 12:
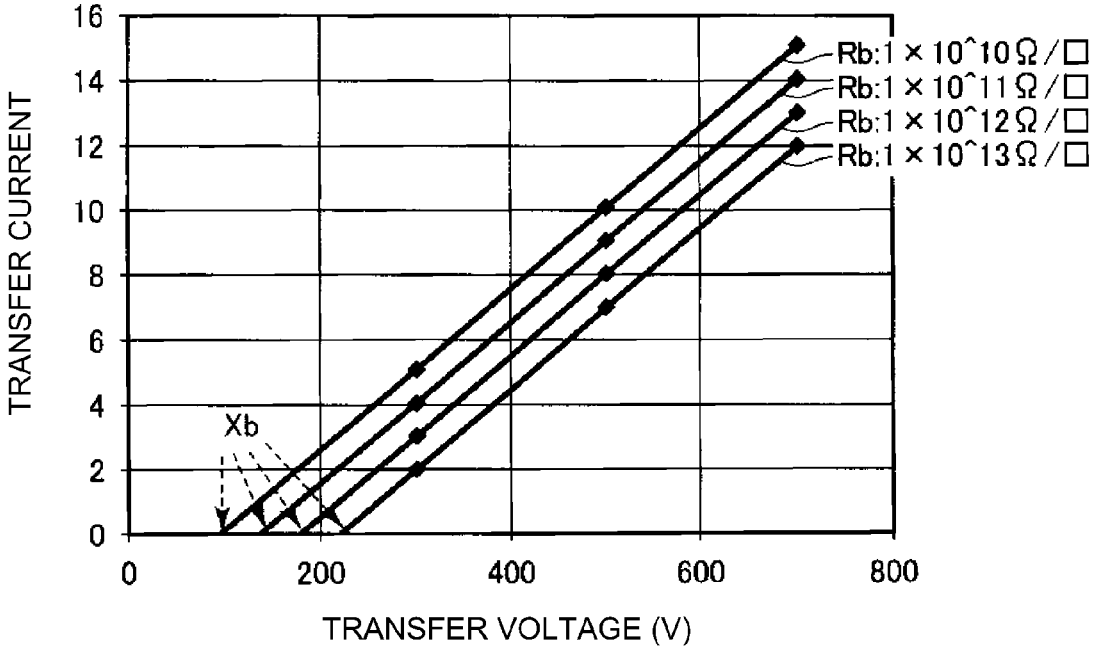
FIG. 12 is a graph showing a relationship between the voltage value of the transfer voltage and the current value in a comparison manner in the case where the transfer belt surface resistance is different.

FIG. 12 shows a relationship between the adjusting voltage values V1, V2 and V2 and the detected current values I1, I2 and I3 which are measured every surface resistance of the transfer belt 21 similarly as during the above-described transfer voltage control. In this case, V1=300 V, V2=500 V and V3=700 V were set. From FIG. 12, it is understood that depending on a difference in surface resistance of the transfer belt 21, there is a difference in intercept Xb of X-axis (transfer voltage, hereinafter referred to as an energization start voltage) of a relationship between the voltage value and the current value (V-I characteristic). That is, it is understood that the energization start voltage Xb is smaller with a lower value of the surface resistance of the transfer belt 21.

Figure 13:
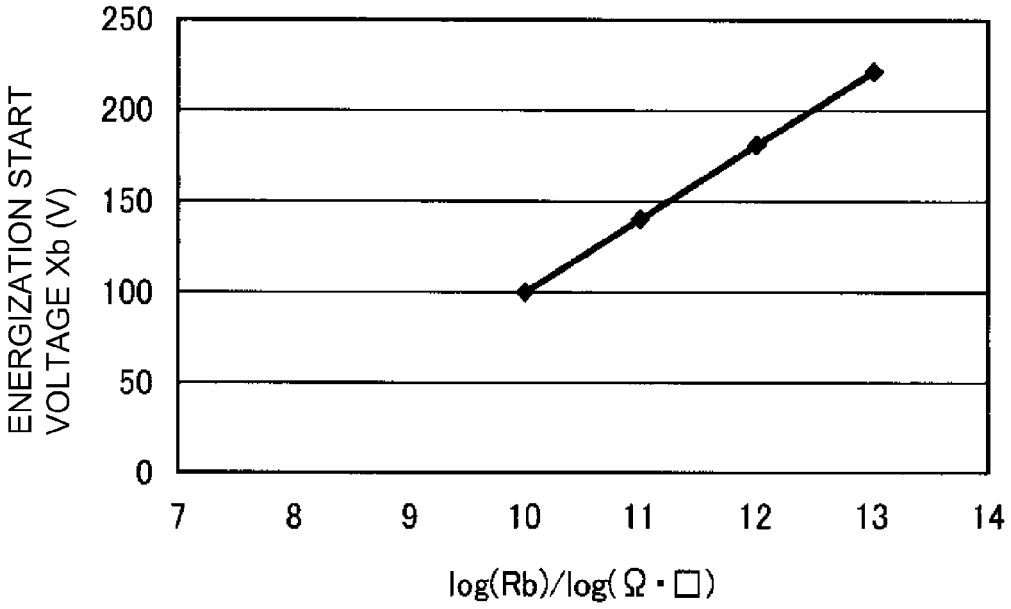
FIG. 13 is a graph showing a relationship between the transfer belt surface resistance and an energization start voltage of the transfer voltage.

FIG. 13 shows a relationship between a surface resistance Rb of the transfer belt 21 and the energization start voltage Xb. From FIG. 13, it is understood that there is a certain correlation between the surface resistance of the transfer belt 21 and the energization start voltage Xb. Accordingly, in the image forming apparatus 100, it becomes possible to estimate the surface resistance Rb of the transfer belt 21 by obtaining the energization start voltage Xb. Specifically, similarly as during the above-described transfer voltage control, the relationship between the voltage value of the transfer voltage and the current value is obtained and then the intercept of the X-axis (transfer voltage) of the relationship is obtained, so that the energization start voltage Xb can be obtained. Then, it is possible to obtain the surface resistance Rb of the transfer belt 21 by making reference to the relationship between the surface resistance Rb of the transfer belt 21 and the energization start voltage Xb as shown in FIG. 13.

Figure 14:
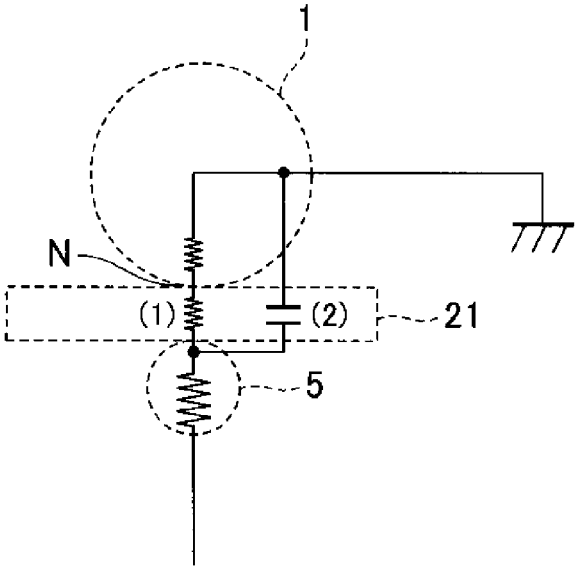
FIG. 14 is a schematic view for illustrating a current path at a transfer portion.

Next, a current path at the transfer portion N will be described. FIG. 14 schematically shows the current path at the transfer portion N. The current path at the transfer portion N is divided into the following two paths (1) and (2).

Path (1): Path of the current flowing from the transfer roller 5 toward the photosensitive drum 1 through the transfer belt Path (2): Path of the current flowing due to electrostatic capacity of the transfer belt 21

A current necessary for the transfer is the current flowing through the path (1). On the other hand, the capacity of the path (2) has the influence on the above-described energization start voltage Xb and correlates with the electric resistance of the transfer belt 21. Accordingly, an optimum transfer current Ip can be obtained using the relationship between the energization start voltage Xb and the surface resistance of the transfer belt 21 obtained through the experiment or the like in advance.

Figure 15:
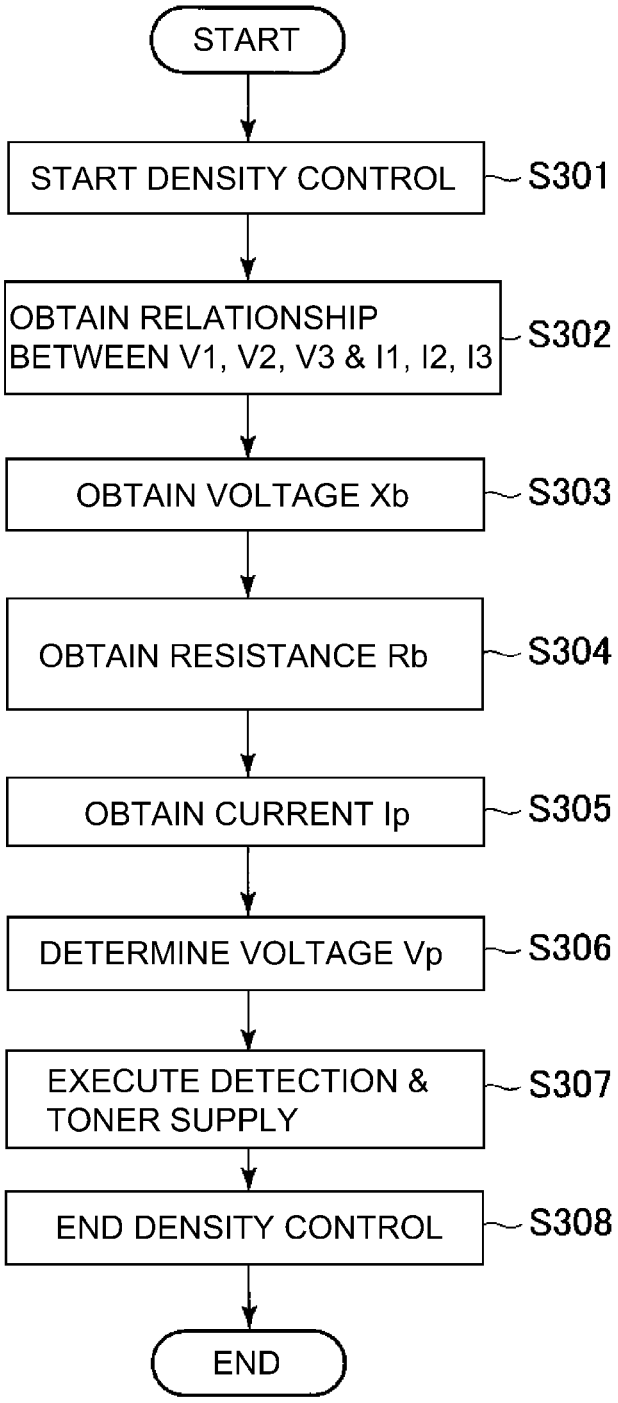
FIG. 15 is a flowchart showing a density control procedure.

With reference to FIG. 15, the density control including the target transfer current adjusting control in this embodiment will be further described. FIG. 15 is a flowchart showing an outline of the procedure of the control.

When the density control is started (S301), the CPU 61 performs an operation for obtaining a relationship between the adjusting voltage values V1, V2 and V3 and the detected current values I1, I2 and I3 similarly as during the above-described transfer voltage control (S302). Then, the CPU 61 obtains the energization start voltage Xb from the obtained relationship between the voltage values and the current values (S303). Then, the CPU 61 obtains the surface resistance Rb of the transfer belt 21 from the obtained energization start voltage Xb by making reference to the information, on the relationship between the surface resistance Rb of the transfer belt 21 and the energization start voltage Xb as shown in FIG. 13, stored in the ROM 63 (S304). Then, from the obtained surface resistance Rb of the transfer belt 21, the CPU 61 determines the target current value (optimum current value) Ip of the transfer current for transferring the patch T onto the transfer belt 21 by making reference to the information, on the relationship between the surface resistance Rb and the optimum current value as shown in FIG. 11, stored in the ROM 63 (S305). Next, from the relationship between the voltage value and the current value obtained in the step of S302, the CPU 61 determines a target voltage value Vp of the transfer voltage for obtaining the target current value Ip determined in the step of S305 (S306). Next, the CPU 61 forms the patch T on the transfer belt 21 and then adjusts the toner density of the developer (S307). In this case, the patch T is transferred onto the transfer belt 21 using the target voltage value Vp determined in the step S306. Thereafter, the CPU 61 ends the density control after the toner density adjustment for the developer is ended (S308).

As described above, the image forming apparatus 100 includes the CPU 61 as the control means for executing the density control in which the toner density of the developer is adjusted. This density control is an example of the adjusting operation in which the predetermined patch T formed on the photosensitive drum 1 is transferred onto the transfer belt 21 and the density of the patch T is detected by the density sensor 40 and then depending on the difference between the density of the patch T detected by the density sensor 40 and the reference value, the object to be adjusted is adjusted. Further, the image forming apparatus 100 includes the obtaining means for obtaining the information on the electric resistance of the transfer belt 21. In this embodiment, the obtaining means is constituted by the transfer voltage source E, the transfer ammeter 70, the CPU 61 and the like, and obtains the information on the electric resistance of the transfer belt 21 from the information on the voltage value and the current value when the voltage is outputted from the transfer voltage source E. Then, the CPU 61 changes the voltage, outputted from the transfer voltage source E for transferring the patch T in the density control, depending on the information on the electric resistance of the transfer belt 21 obtained by the above-described obtaining means. Particularly, in this embodiment, the CPU 61 changes the voltage outputted from the transfer voltage source E for transferring the patch T in the density control so that the current supplied to the transfer portion N by the voltage becomes smaller with a lower value of the electric resistance of the transfer belt 21 indicated by the information obtained by the above-described obtaining means.

As described above, according to this embodiment, it is possible to suppress the fluctuation, in density of the patch T transferred onto the transfer belt 21, caused due to the fluctuation (lowering or raising) in surface resistance of the transfer belt 21 resulting from the repetitive use or the like of the transfer belt 21. As a result, the toner density of the developer can be properly controlled, so that the image density fluctuation and the generation of the defective image are suppressed and thus a good image can be formed for a long term. Accordingly, according to this embodiment, in the constitution in which the density control is effected by detecting the density of the patch T on the transfer belt 21, it is possible to suppress the lowering in accuracy of the density control caused due to the fluctuation in electric resistance of the transfer belt 21. Further, in this embodiment, on the transfer belt 21, the patches T of the plurality of colors can be read by the common density sensor 40, and therefore it is possible to effect the density control with high accuracy as described above while suppressing the increase in cost and size of the image forming apparatus 100 and the complication.

Figure 16:
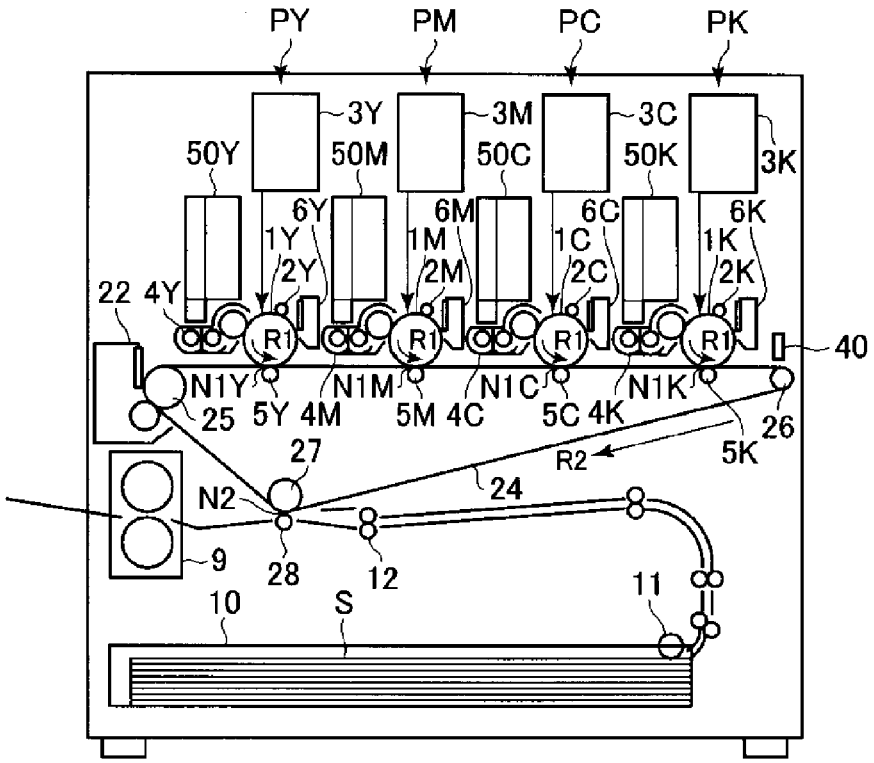
FIG. 16 is a schematic sectional view of an image forming apparatus in Embodiment 2.

Incidentally, in the above, the image forming apparatus 100 of the direct transfer type was described as an example, but the present invention can be applied to also the image forming apparatus of the intermediary transfer type. FIG. 16 is a schematic sectional view of an image forming apparatus of an intermediary transfer type. In the image forming apparatus of the intermediary transfer type shown in FIG. 16, elements having the same or corresponding functions and constitutions as those in the image forming apparatus of the direct transfer type shown in FIG. 1 are represented by the same reference numerals or symbols. The image forming apparatus 100 in FIG. 16 includes, in place of the transfer belt 21 in the image forming apparatus 100 in FIG. 1, an intermediary transfer belt 24 which is an intermediary transfer member constituted by an endless belt-shaped sheet (film). The intermediary transfer belt 24 is an example of the image feeding sheet onto which the toner image is transferred from the image bearing member. The intermediary transfer belt 24 is wound with predetermined tension around a driving roller 25, a tension roller 26 and a secondary transfer opposite roller 27 which are a plurality of supporting rollers. In an inner peripheral surface (back surface) side of the intermediary transfer belt 24, at a position opposing the associated one of the photosensitive drums 1 of the image forming portions P, the primary transfer roller 5 which is a roller-shaped primary transfer member as a primary transfer means similar to the transfer roller 5 in the image forming apparatus 100 in FIG. 1 is disposed. The primary transfer roller 5 is urged (pressed) toward the photosensitive drum 1 through the intermediary transfer belt 24, and forms a primary transfer portion (primary transfer nip) N1 where the intermediary transfer belt 24 and the photosensitive drum 1 are in contact with each other. Further, in an outer peripheral surface (front surface) side of the intermediary transfer belt 24, at a position opposing the secondary transfer opposite roller 27, a secondary transfer roller 28 which is a roller-shaped secondary transfer member as a secondary transfer means is disposed, and forms a secondary transfer portion (secondary transfer nip) N2 where the intermediary transfer belt 24 and the secondary transfer opposite roller 27 are in contact with each other.

The toner images formed on the photosensitive drums 1 of the image forming portions P are electrostatically successively transferred (primary transferred) superposedly onto the intermediary transfer belt 24 by the action of the primary transfer rollers 5 at the primary transfer portions (primary transfer nip) N1. At this time, to each of the primary transfer rollers 5, a primary transfer voltage (primary transfer bias) which is a DC voltage of an opposite polarity to the normal charge polarity of the toner is applied. The toner images on the intermediary transfer belt 24 are electrostatically transferred (secondary-transferred) onto the transfer material S by the action of the secondary transfer roller 28 at the secondary transfer portion N2. At this time, to the secondary transfer roller 28, a secondary transfer voltage (secondary transfer bias) which is a DC voltage of the opposite polarity to the normal charge polarity of the toner is applied. As the intermediary transfer belt 24, it is possible to use a belt similar to the transfer belt 21 in this embodiment. In the image forming apparatus 100 in FIG. 16, in the density control, the patch T is formed on the intermediary transfer belt 24. Then, the density of this patch T is detected by the density sensor 40 disposed opposite to the intermediary transfer belt 24 at a position downstream of the downstream-most primary transfer portion N1K and upstream of the secondary transfer portion N2 with respect to the movement direction of the intermediary transfer belt 24. Accordingly, the target current value of a transfer current when the patch T is transferred onto the intermediary transfer belt 24 is adjusted similarly as in the case of the image forming apparatus 100 of the direct transfer type, whereby it becomes possible to suppress a lowering in accuracy of the density control due to a fluctuation in surface resistance of the intermediary transfer belt 24.

Embodiment 2

Next, another embodiment of the present invention will be described. Basic constitutions and operations of the image forming apparatus in this embodiment are the same as those of the image forming apparatus of the intermediary transfer type described in Embodiment 1 with reference to FIG. 16. Accordingly, elements having the same or corresponding functions and constitutions as those described in Embodiment 1 are represented by the same reference numerals or symbols and will be omitted from detailed description.

In Embodiment 1, the surface resistance Rb of the intermediary transfer belt 24 was obtained from the relationship between the voltage value of the transfer voltage and the current value (specifically, from the energization start voltage Xb which is the intercept of the X-axis (transfer voltage)). On the other hand, in this embodiment, a method of obtaining the surface resistance Rb of the intermediary transfer belt 24 is different from the method in Embodiment 1.

As one of caused by which the electric resistance of the intermediary transfer belt 24 changes, the following cause would be considered. That is, in the secondary transfer step, minute electric discharge generates between the intermediary transfer belt 24 and the transfer material S charged by transfer electric charges or movement of the electric charges from the transfer material S to the intermediary transfer belt 24 generates, so that electroconductive particles on the surface of the intermediary transfer belt 24 are electrically charged. An electric field locally generates between the charged electroconductive particles and other electroconductive particles in the neighborhood of the charged electroconductive particles, and in the case where the electric field is strong, electric discharge generates between these two species of the electroconductive particles, so that a resin portion sandwiched between the electroconductive particles is degraded and carbonized under application of heat by the electric discharge. The carbonized resin portion loses its insulative property and becomes an electroconductor. It would be considered that a degree of dielectric breakdown in a local region enlarges gradually during repetition of the secondary transfer step, and thus the surface resistance of the intermediary transfer belt 24 lowers.

Figure 17:
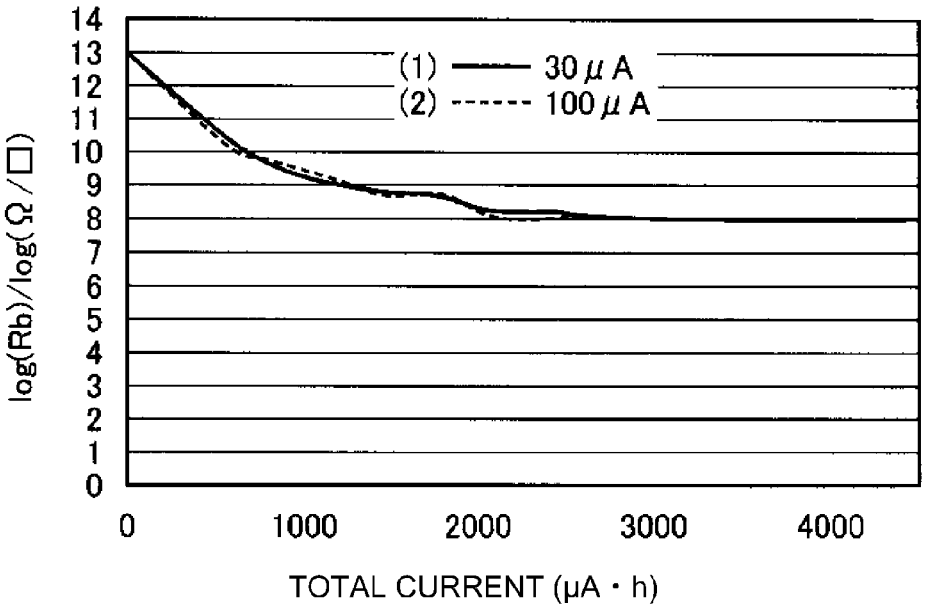
FIG. 17 is a graph showing a relationship between a total amount of a current supplied to a secondary transfer portion and a surface resistance of an intermediary transfer belt.

FIG. 17 shows a result of a measurement of a relationship between a total current amount of the secondary transfer current supplied to the secondary transfer portion N2 and the surface resistance Rb of the intermediary transfer belt 24 in the image forming apparatus 100. In FIG. 17, a result (1) shows progression of the surface resistance of the intermediary transfer belt 24 in the case where the target current value for the secondary transfer voltage is 30 μA, and a result (2) shows progression of the surface resistance of the intermediary transfer belt 24 in the case where the target current value for the secondary transfer voltage is 100 μA. From FIG. 17, it is understood that the progression of the surface resistance of the intermediary transfer belt 24 is determined by the total current amount of the current supplied to the secondary transfer portion N2 independently of the target current value for the secondary transfer voltage.

Therefore, in this embodiment, a total current amount Ctr2_all of the current supplied to the secondary transfer portion N2 in the image forming apparatus 100 is integrated and stored. Then, using this total current amount Ctr2_all, the surface resistance Rb of the intermediary transfer belt 24 is obtained. In this way, in this embodiment, from an integrated value of the amount of the current supplied for transferring the toner image on the secondary transfer portion N2, information on the electric resistance (surface resistance) of the intermediary transfer belt 24 is obtained.

Figure 18:
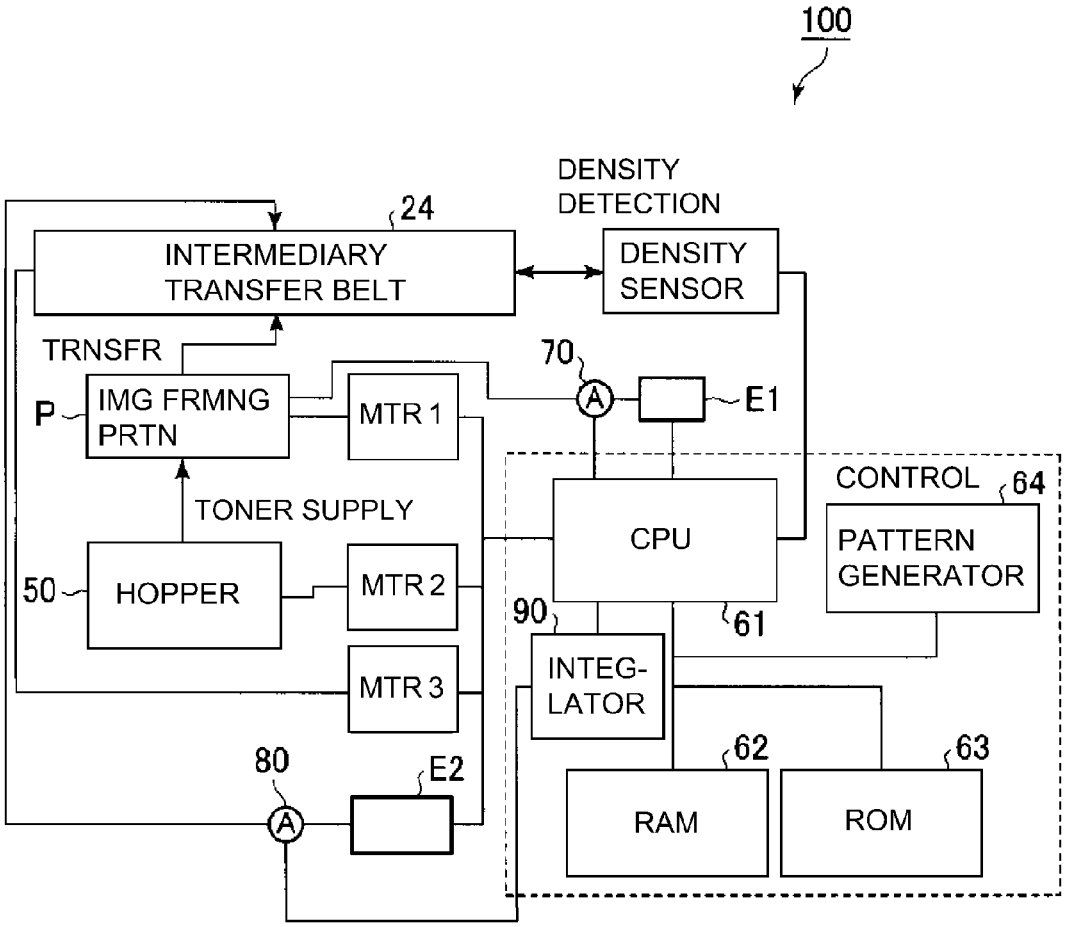
FIG. 18 is a block diagram showing a control manner of a principal portion of the image forming apparatus in Embodiment 2.

FIG. 18 is a block diagram showing a schematic control manner of a principal part of the image forming apparatus 100 in this embodiment. A basic constitution of this block diagram is similar to that in Embodiment 1 shown in FIG. 4, but in this embodiment, in place of the transfer voltage source E and the transfer ammeter 70 in FIG. 4, a primary transfer voltage source E1 and a primary transfer ammeter 70 which have functions similar to those of the transfer voltage source E and the transfer ammeter 70, respectively.

In this embodiment, a secondary transfer voltage source E2 as a secondary transfer voltage applying means, a secondary transfer current measuring circuit 80 for measuring a secondary transfer current (also referred to as a secondary transfer ammeter) and a total current amount integrating portion 90 are provided. The secondary transfer ammeter 80 can detect a value of a DC current flowing through the secondary transfer roller 28 when the secondary transfer voltage source E2 applies a DC voltage to the secondary transfer roller 28. The total current amount integrating portion 90 successively integrates and stores the secondary transfer current supplied to the secondary transfer portion N2 from start of use of the intermediary transfer belt 24 until now.

Figure 19:
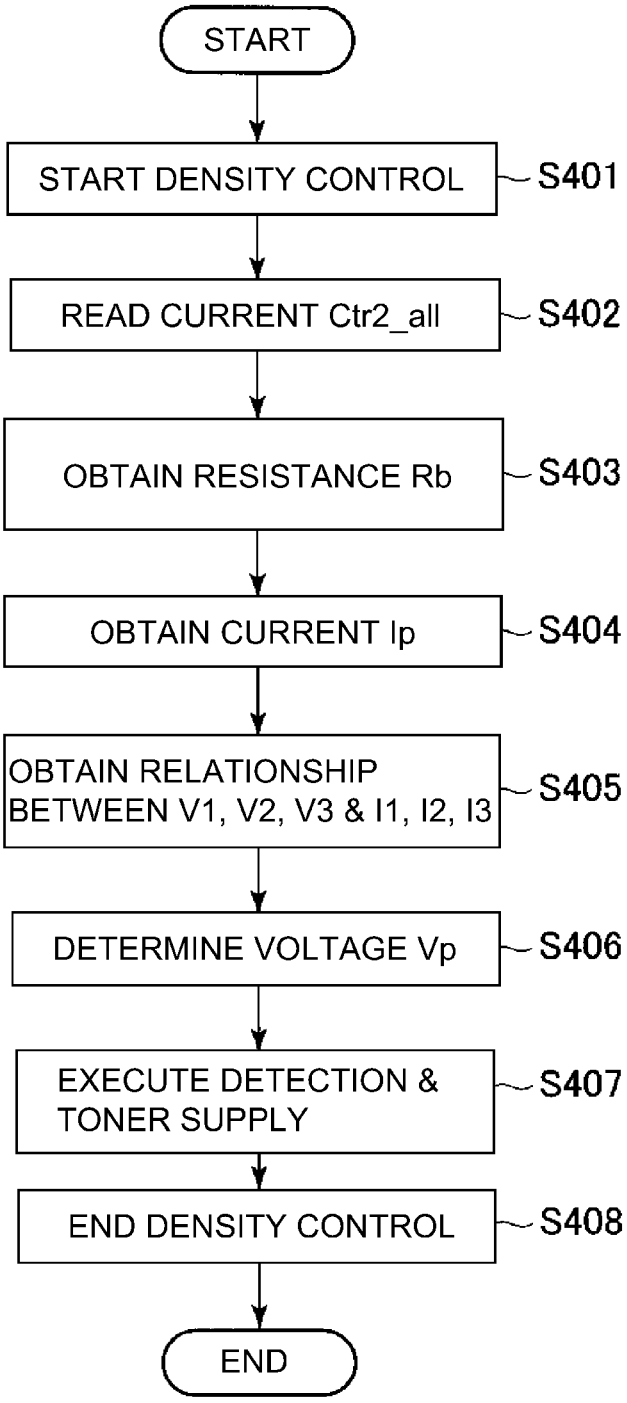
FIG. 19 is a flowchart showing a density control procedure in Embodiment 2.
Figure 20:
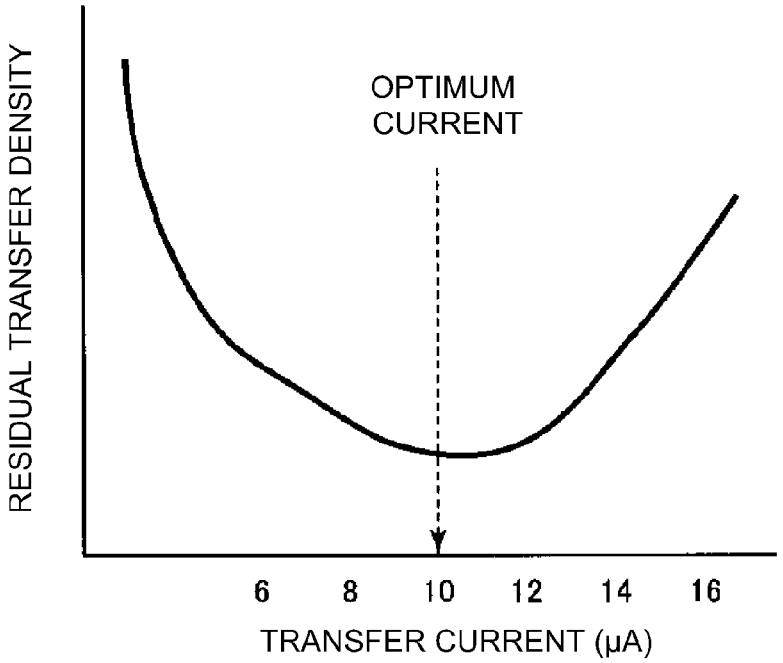
FIG. 20 is a graph showing a relationship between a transfer current and a transfer residual (toner) density.
Figure 21:
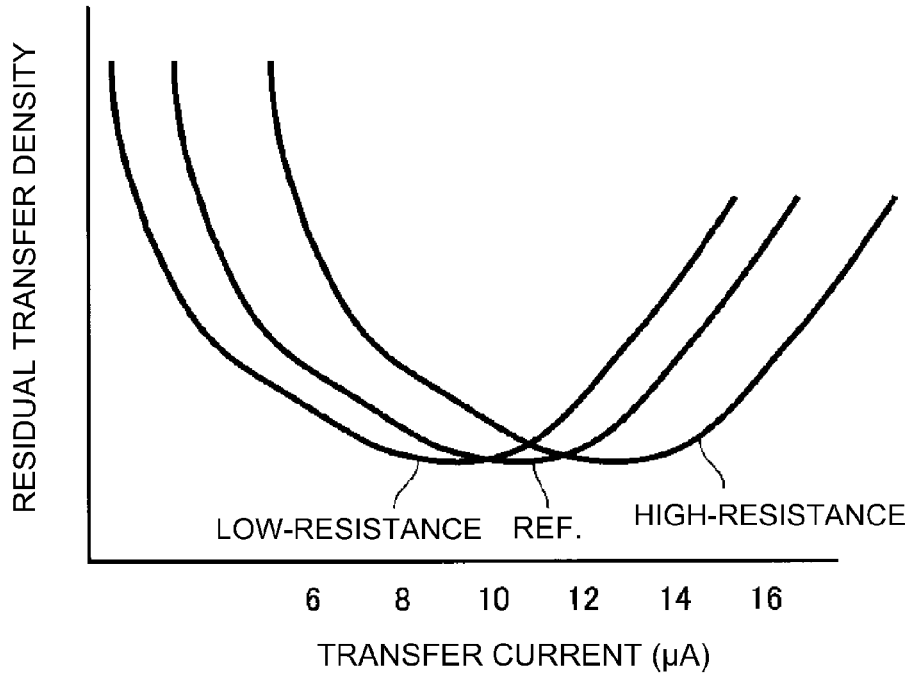
FIG. 21 is a graph showing a relationship between the transfer current and the transfer residual density in a comparison manner in the case where a surface resistance of an image feeding sheet is different.

With reference to FIG. 19, the density control including the target transfer current adjusting control in this embodiment will be further described. FIG. 19 is a flowchart showing an outline of the procedure of the control.

When the density control is started (S401), the CPU 61 reads the total current amount Ctr2_all from the total current amount integrating portion 90 (S402). Then, the CPU 61 obtains the surface resistance Rb of the intermediary transfer belt 24 by making reference to the information, on the relationship between the total current amount Ctr2_all and the surface resistance Rb of the transfer belt 21 as shown in FIG. 17, stored in the ROM 63 (S403). Then, from the obtained surface resistance Rb of the intermediary transfer belt 24, the CPU 61 determines the target current value (optimum current value) Ip of the transfer current for transferring the patch T onto the transfer belt 21 by making reference to the information, on the relationship between the surface resistance Rb and the optimum current value as shown in FIG. 11, stored in the ROM 63 (S404). Next, the CPU 61 executes an operation for obtaining the relationship between the adjusting voltage values V1, V2 and V3 and the detected current values I1, I2 and I3 similarly as during the transfer voltage control described in Embodiment 1 (S405). Next, from the relationship between the voltage value and the current value obtained in the step of S405, the CPU 61 determines a target voltage value Vp of the transfer voltage for obtaining the target current value Ip determined in the step of S404 (S406). Next, the CPU 61 forms the patch T on the intermediary transfer belt 24 and then adjusts the toner density of the developer (S407). In this case, the patch T is transferred onto the intermediary transfer belt 24 using the target voltage value Vp determined in the step S406. Thereafter, the CPU 61 ends the density control after the toner density adjustment for the developer is ended (S408).

As described above, according to this embodiment, it is possible to suppress the fluctuation, in density of the patch T transferred onto the intermediary transfer belt 24, caused due to the fluctuation in surface resistance of the intermediary transfer belt 24. As a result, the toner density of the developer can be properly controlled, so that the image density fluctuation and the generation of the defective image are suppressed and thus a good image can be formed for a long term. Accordingly, according to this embodiment, in the constitution in which the density control is effected by detecting the density of the patch T on the intermediary transfer belt 24, it is possible to suppress the lowering in accuracy of the density control caused due to the fluctuation in electric resistance of the intermediary transfer belt 24.

OTHER EMBODIMENTS

The present invention was described based on the specific embodiments mentioned above, but is not limited to the above-mentioned embodiments.

For example, Embodiment 2 is applied to the image forming apparatus of the intermediary transfer type, and in Embodiment 2, the surface resistance of the intermediary transfer member was obtained on the basis of the total current amount of the current supplied to the secondary transfer portion. However, the fluctuation in electric resistance (surface resistance) of the image feeding sheet is estimated from the total current amount of the supplied current. That is, in the image forming apparatus of the intermediary transfer type, it is possible to obtain the information on the electric resistance (surface resistance) of the intermediary transfer member from the integrated value of the amount of the current supplied to the primary transfer portion for transferring the toner image. Further, in the image forming apparatus of the direct transfer type, it is possible to obtain the information on the electric resistance (surface resistance) of the transfer material carrying material from the amount of the current supplied to the transfer portion for transferring the toner image. In the case where a plurality of primary transfer portions or transfer portions are provided, on the basis of the total current amount of the current supplied to either one or any two or more transfer portions, it is possible to obtain the electric resistance of the intermediary transfer member or the transfer material carrying material.

Further, in the above-described embodiments, the case where the image feeding sheet is the endless belt-shaped sheet stretched by the plurality of the supporting rollers was described, but the image feeding sheet may also be a drum-shaped sheet formed by stretching a sheet (film) by a frame for example.

Further, in the above-described embodiments, the transfer voltage was described as being subjected to the constant-voltage control during the image formation, but may also be subjected to constant-current control. Further, in the above-described embodiments, in the transfer voltage control and the density control, the information on the voltage value and the current value is obtained by detecting the current value when the voltage having a predetermined adjusting voltage value is applied, but the present invention is not limited thereto. The information on the electrical resistance at the transfer portion may only be required to be obtained, and therefore the information on the voltage value and the current value may also be obtained by detecting a generated voltage value when a current having a predetermined adjusting current value is supplied.

Further, in the above-described embodiments, the case where the object to be adjusted in the adjusting operation using the patch was the toner density (toner content) of the developer was described. However, the object to be adjusted in the adjusting operation using the patch is not limited thereto. For example, as is well known, the image density or the like is adjusted in some cases by adjusting other objects to be adjusted, such as a charging condition or an exposure condition of the photosensitive member, a developing condition of the electrostatic latent image, and an image signal (gradation correction), depending on a detection result of the patch density. Thus, also in adjusting operations of other objects to be adjusted different from the toner density of the developer, in the adjusting operation for adjusting the object to be adjusted depending on a difference between the detected patch density and the reference value, a problem similar to that in the case where the object to be adjusted is the toner density of the developer can occur. Accordingly, also in such a case, by applying the present invention similar as in the above-described embodiments, it becomes possible to suppress the lowering in accuracy of the adjustment.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-186412 filed on Sep. 12, 2014, which is hereby incorporated by reference herein in its entirety.

What is claimed is:

1. An image forming apparatus comprising:

an image bearing member;

a toner image forming unit for forming a toner image on said image bearing member;

an intermediary transfer belt for carrying the toner image transferred from said image bearing member;

a transfer member for transferring the toner image from said image bearing member onto said intermediary transfer belt at a transfer portion;

a transfer voltage source for generating a voltage applied to said transfer member;

an obtaining portion for obtaining information on an electric resistance of said intermediary transfer belt;

a detecting member for optically detecting a test toner image formed on said image bearing member and transferred on said intermediary transfer belt; and an executing portion for executing, on the basis of a detection result of the test toner image by said detecting member, an adjusting operation for adjusting an image forming condition of said toner image forming unit, a controller configured to control, on the basis of the information obtained by said obtaining portion, a transfer condition at the time when the test toner image formed on said image bearing member is transferred onto said intermediary transfer belt, said controller controlling the voltage applied to said transfer member so as to provide a predetermined target current flowing through said transfer member, and a changing portion for changing the target current on the basis of the information obtained by said obtaining portion.

2. An image forming apparatus according to claim 1, wherein when an output of said obtaining portion is indicative of a first resistance of said intermediary transfer belt, said changing portion sets the target current at a first target current, and when the output of said obtaining portion is indicative of a second resistance of said intermediary transfer belt, said changing portion sets the target current at a second target current which is lower than the first target current.

3. An image forming apparatus according to claim 1, wherein said obtaining portion obtains the information on the electric resistance of said intermediary transfer belt from information on a value of the voltage of said transfer voltage source applied to said transfer member and a value of a current flowing through said transfer member.

4. An image forming apparatus according to claim 3, wherein said obtaining portion obtains the information on the electric resistance of said intermediary transfer belt on the basis of a voltage value at which the current starts to flow in a relationship between the voltage value and the current value.

5. An image forming apparatus according to claim 1, wherein said obtaining portion obtains the information on the electric resistance of said intermediary transfer belt from an integrated value of an amount of a current supplied to the transfer portion where transfer of the toner image from said intermediary transfer belt onto the recording material is made.

6. An image forming apparatus according to claim 1, wherein said obtaining portion obtains the information on the electric resistance of said intermediary transfer belt from an integrated value of an amount of a current supplied to the transfer portion where transfer of the toner image from said image bearing member onto said intermediary transfer belt is made.

7. An image forming apparatus according to claim 1, wherein the information on the electric resistance of said intermediary transfer belt is information on a surface resistance of said intermediary transfer belt.

8. An image forming apparatus according to claim 1, wherein the image forming condition is a toner content of a developer used in said toner image forming unit.

9. An image forming apparatus comprising:

an image bearing member;

a toner image forming unit for forming a toner image on said image bearing member;

a transfer material carrying member for carrying a transfer material onto which the toner image is to be transferred;

a transfer member for transferring the toner image from said image bearing member onto the transfer material on said transfer material carrying member at a transfer portion;

a transfer voltage source for generating a voltage applied to said transfer member;

an obtaining portion for obtaining information on an electric resistance of said transfer material carrying member;

a detecting member for optically detecting a test toner image formed on said image bearing member and transferred onto the transfer material on said transfer material carrying member;

an executing portion for executing, on the basis of a detection result of the test toner image by said detecting member, an adjusting operation for adjusting an image forming condition of said toner image forming unit;

a controller configured to control, on the basis of the information obtained by said obtaining portion, a transfer condition at the time when the test toner image formed on said image bearing member is transferred onto the transfer material on said transfer material carrying member, said controller controlling the voltage applied to said transfer member so as to provide a predetermined target current flowing through said transfer member; and a changing portion for changing the target current on the basis of the information obtained by said obtaining portion.

10. An image forming apparatus according to claim 9, wherein said obtaining portion obtains the information on the electric resistance of said transfer material carrying member from an integrated value of an amount of a current supplied for toner image transfer to the transfer portion where transfer of the toner image from said image bearing member onto the transfer material is made.

* * * * *